US005584897A

United States Patent [19]

Christianson et al.

[11] Patent Number: 5,584,897

[45] Date of Patent: Dec. 17, 1996

[54] METHOD FOR MAKING AN ENDLESS COATED ABRASIVE ARTICLE

[75] Inventors: Todd J. Christianson, Oakdale; Harold W. Benedict, Cottage Grove, both of Minn.

[73] Assignee: Minnesota Mining and Manufacturing Company, St. Paul, Minn.

[21] Appl. No.: 580,793

[22] Filed: Dec. 29, 1995

Related U.S. Application Data

[63] Continuation of Ser. No. 199,835, Feb. 22, 1994, abandoned.

[51] Int. Cl.[6] ..... B24D 11/00

[52] U.S. Cl. ..... 51/295; 51/297; 156/137

[58] Field of Search ..... 51/293, 295, 297; 156/137

[56] References Cited

U.S. PATENT DOCUMENTS

| | | | |
|---|---|---|---|
| Re. 25,587 | 6/1964 | Wiltshire | 264/114 |
| 289,879 | 12/1883 | Almond | 451/524 |
| 1,412,309 | 4/1922 | Lambert | 156/137 |
| 1,676,845 | 7/1928 | Teisher | 474/271 |
| 1,924,355 | 8/1933 | Freedlander | 154/4 |
| 2,032,356 | 3/1936 | Ellis | 51/278 |
| 2,209,074 | 7/1940 | Dahlstrom | 51/188 |
| 2,333,035 | 10/1943 | Oglesby | 51/185 |
| 2,349,365 | 5/1944 | Martin et al. | 51/197 |
| 2,356,249 | 8/1944 | Kremer et al. | 154/4 |
| 2,365,866 | 8/1944 | Melton et al. | 51/293 |
| 2,391,731 | 12/1945 | Miller | 51/188 |
| 2,404,207 | 7/1946 | Ball | 51/188 |
| 2,411,724 | 11/1946 | Hill | 51/293 |
| 2,468,853 | 5/1949 | Williamson | 51/294 |
| 2,590,697 | 3/1952 | Grove | 51/297 |
| 2,682,733 | 7/1954 | Buckner | 51/188 |
| 2,704,735 | 3/1955 | Hedges et al. | 154/120 |

(List continued on next page.)

FOREIGN PATENT DOCUMENTS

| | | | |
|---|---|---|---|
| 1023563 | 1/1978 | Canada . | |
| 095055 | 11/1983 | European Pat. Off. | B24D 11/00 |
| 142140 | 5/1985 | European Pat. Off. | B24D 11/06 |
| 213353 | 3/1987 | European Pat. Off. | B24D 11/06 |
| 321959 | 6/1989 | European Pat. Off. | D04H 1/56 |

(List continued on next page.)

OTHER PUBLICATIONS

"Air Products Announces Trademark Changes for Polyurethane Prepolymers and Curatives" News Release #94034 from Air Products & Chemicals, Inc., 2 pages (Jan. 3, 1994).

"American National Standard for Grading of Certain Abrasive Grain on Coated Abrasive Material", sponsored by Grinding Wheel Institute (ANSI Standard B74.18–1984), 32 pages (Jan. 27, 1984).

(List continued on next page.)

*Primary Examiner*—Deborah Jones

*Attorney, Agent, or Firm*—Gary L. Griswold; Walter N. Kirn; Richard Francis

[57] ABSTRACT

A method of making a coated abrasive article, and the product thereof, involving the steps of: providing a backing sheet having two free sheet ends and joining the two free sheet ends together as a splice to form an endless backing sheet; temporarily supporting the backing sheet before or after performing the splicing; applying fibrous reinforcing material onto a major surface of the endless backing sheet such as by winding at least one continuous fibrous strand or narrow fibrous strip in a plurality of revolutions around the endless backing sheet with applying of a first binder precursor to the fibrous reinforcing material such that the first binder precursor bonds the fibrous reinforcing material to the second major surface of the endless backing to form a reinforcing fiber layer; exposing the first binder precursor to conditions effective to solidify the first binder precursor; and forming an abrasive coating on the surface of one of the fiber reinforcing layer, or alternatively, the exposed surface of the backing sheet before or after applying the reinforcing fiber to the opposite side of the belt.

29 Claims, 3 Drawing Sheets

U.S. PATENT DOCUMENTS

| | | | |
|---|---|---|---|
| 2,712,987 | 7/1955 | Storrs et al. | 51/293 |
| 2,743,559 | 5/1956 | Ball et al. | 51/183 |
| 2,773,540 | 12/1956 | Waugh | 154/4 |
| 2,785,442 | 3/1957 | Boggs | 18/58.3 |
| 2,983,637 | 5/1961 | Schmidt | 154/52.1 |
| 2,995,176 | 8/1961 | Waugh | 154/4 |
| 2,999,780 | 9/1961 | Perrault | 154/83 |
| 3,030,743 | 4/1962 | Raymond | 51/207 |
| 3,166,388 | 1/1965 | Riegger et al. | 51/196 |
| 3,276,852 | 10/1966 | Lemelson | 51/298 |
| 3,333,372 | 8/1967 | Gianatasio | 51/399 |
| 3,561,938 | 2/1971 | Block et al. | 51/358 |
| 3,562,968 | 2/1971 | Johnson et al. | 51/389 |
| 3,577,872 | 5/1971 | Drummond | 57/35 |
| 3,607,502 | 9/1971 | Marzocchi et al. | 156/142 |
| 3,729,873 | 5/1973 | Sandell | 51/399 |
| 3,860,400 | 1/1975 | Prowse et al. | 51/295 |
| 3,900,355 | 8/1975 | Goto et al. | 156/74 |
| 4,018,574 | 4/1977 | Dyer | 51/295 |
| 4,049,767 | 9/1977 | Vaidya | 264/257 |
| 4,163,647 | 8/1979 | Swiatek | 51/295 |
| 4,253,836 | 3/1981 | Miranti, Jr. | 474/200 |
| 4,256,467 | 3/1981 | Gorsuch | 51/295 |
| 4,282,011 | 8/1981 | Terpay | 51/298 |
| 4,289,168 | 9/1981 | Lecourt et al. | 138/109 |
| 4,314,827 | 2/1982 | Leitheiser et al. | 51/298 |
| 4,373,933 | 2/1983 | Grazen | 51/309 |
| 4,394,340 | 7/1983 | Tarumi et al. | 264/219 |
| 4,455,343 | 6/1984 | Temple | 428/285 |
| 4,525,177 | 6/1985 | Grimes et al. | 51/295 |
| 4,554,765 | 11/1986 | Grimes et al. | 51/401 |
| 4,588,419 | 5/1986 | Caul et al. | 51/295 |
| 4,609,581 | 9/1986 | Ott et al. | 428/100 |
| 4,652,274 | 3/1987 | Boettcher et al. | 51/298 |
| 4,652,275 | 3/1987 | Bloecher et al. | 51/298 |
| 4,653,236 | 3/1987 | Grimes et al. | 51/401 |
| 4,681,558 | 7/1987 | Rausch | 474/205 |
| 4,734,104 | 3/1988 | Broberg | 51/295 |
| 4,736,549 | 4/1988 | Toillie | 51/399 |
| 4,744,802 | 5/1988 | Schwabel | 51/309 |
| 4,770,671 | 9/1988 | Monroe et al. | 51/293 |
| 4,799,939 | 1/1989 | Bloecher et al. | 51/293 |
| 4,867,760 | 9/1989 | Yarbrough | 51/298 |
| 4,881,951 | 11/1989 | Wood et al. | 51/309 |
| 4,894,280 | 1/1990 | Guthrie et al. | 428/224 |
| 4,903,440 | 2/1990 | Larson et al. | 51/298 |
| 4,906,523 | 3/1990 | Bilkadi et al. | 428/327 |
| 4,960,442 | 10/1990 | Wagner et al. | 51/295 |
| 5,011,508 | 4/1991 | Wald et al. | 51/293 |
| 5,078,753 | 1/1992 | Broberg et al. | 51/298 |
| 5,108,462 | 4/1992 | Habeeb et al. | 44/383 |
| 5,109,638 | 5/1992 | Kime, Jr. | 51/401 |
| 5,137,542 | 8/1992 | Buchanan et al. | 51/295 |
| 5,203,884 | 4/1993 | Buchanan et al. | 51/295 |
| 5,219,505 | 6/1993 | Kaiser | 264/138 |
| 5,236,472 | 8/1993 | Kirk et al. | 51/298 |
| 5,316,812 | 5/1994 | Stout et al. | 51/297 |
| 5,341,609 | 8/1994 | Gorsuch et al. | 51/399 |
| 5,344,688 | 9/1994 | Peterson et al. | 428/102 |
| 5,420,015 | 5/1995 | Wuerch | 106/162 |
| 5,436,063 | 7/1995 | Follett et al. | 428/224 |

FOREIGN PATENT DOCUMENTS

| | | | |
|---|---|---|---|
| 333909 | 9/1989 | European Pat. Off. | B65G 15/34 |
| 340982 | 11/1989 | European Pat. Off. | D01F 8/04 |
| 349466 | 1/1990 | European Pat. Off. | B29C 41/04 |
| 533482 | 3/1993 | European Pat. Off. | G03G 15/00 |
| 626238 | 11/1994 | European Pat. Off. | B24D 11/06 |
| 2095185 | 2/1972 | France . | |
| 2250049 | 5/1975 | France | F16G 3/10 |
| 2396625 | 2/1979 | France . | |
| 2657881 | 6/1978 | Germany | B24D 3/28 |
| 1240289 | 7/1971 | United Kingdom | B44D 11/00 |
| 1445520 | 8/1976 | United Kingdom | B24D 17/00 |
| 1475986 | 6/1977 | United Kingdom | B24D 11/02 |
| 1492789 | 11/1977 | United Kingdom | C09J 5/00 |
| 2240736 | 8/1991 | United Kingdom | B24D 3/00 |
| WO86/02306 | 4/1986 | WIPO . | |
| 93/02837 | 2/1993 | WIPO | B24D 3/00 |
| WO93/12911 | 7/1993 | WIPO . | |
| 93/24279 | 12/1993 | WIPO | B24D 3/34 |
| 95/00294 | 1/1995 | WIPO | B24D 11/00 |
| 95/11111 | 4/1995 | WIPO | B24D 3/28 |
| 95/22438 | 8/1995 | WIPO | B24D 11/02 |
| 95/22434 | 8/1995 | WIPO | B24D 3/28 |

OTHER PUBLICATIONS

"Standard Test Methods for Imapct Resistance of Plastics and Electrical Insulating Materials", ASTM Designation: D256–84, 81–102 (Sep. 1984).

"Standard Test Methods for Impact Resistance of Rigid Plastics Sheeting or Parts by Means of a TUP (Falling Weight)", ASTM Designation: D3029–84, 749–764 (Sep. 1984).

"Standard Test Methods for Flexural Properties of Unreinforced and Reinforced Plastics and Electrical Insulating Materials", ASTM Designation: D790–86, 384–397 (1986).

B. F. Goodrich Specialty Polymers & Chemicals Division, "Product Data HYCAR Reactive Liquid Polymers" Brochure dated Apr. 1991 (5 pages).

Henkel Polymers Division, "Epoxy Curing Agents Product Data Sheet for Genamid 747", Identified as P–182 (undated) (2 pages).

"Material Safety Data Sheet–Polytetramethyleneoxide–di–p–aminobenzoate", Polaroid Corporation, No. RCC–209 R–2, 4 pages (Jan. 1984).

*ME*, Nov. 1990 (2 pages).

"NeoRez and NeoPac Water–borne Urethanes for Coatings Applications", ICI Resins US, 3 pages (undated).

"Product Information–Blendur P 120M", Mobay Corporation, 3 pages (undated).

Product Information from Air Products & Chemicals, Inc. regarding Durathane™, 1 page (Jan. 3, 1994).

Shell, "Material Safety Data Sheet", 1 page (Jun. 13, 1995).

*The Nonwoven Handbook*; B. M. Lichstein., Ed.; Association of the Nonwoven Fabrics Industry: New York (1988)–Title page, copyright page, and table of contents only.

"Witcobond® W–290H, Wicobond W–293", Witco Corporation, Organics Division, Bulletin 345, 4 pages (Apr. 1986).

METHOD FOR MAKING AN ENDLESS COATED ABRASIVE ARTICLE

This is a continuation of application Ser. No. 08/199,835, filed Feb. 22, 1994, now abandoned.

BACKGROUND OF THE INVENTION

1. Field of the Invention

The present invention pertains to a method for making a coated abrasive article, and particularly to a method for making a coated abrasive belt having an endless, spliced backing sheet reinforced by continuously applied fibrous strand or strip material, and the product of this method.

2. Description of the Related Art

Coated abrasive articles generally contain an abrasive material, typically in the form of abrasive grains, bonded to a backing by means of one or more adhesive layers. Such articles usually take the form of sheets, discs, belts, bands, and the like, which can be adapted to be mounted on pulleys, wheels, or drums. Abrasive articles can be used for sanding, grinding, or polishing various surfaces of, for example, steel and other metals, wood, wood-like laminates, plastic, fiberglass, leather, or ceramics.

The backings used in coated abrasive articles are typically made of paper, polymeric materials, cloth, nonwoven materials, vulcanized fiber, or combinations of these materials. Many of these materials alone provide unacceptable backings for certain applications because they are not of sufficient strength, flexibility, or impact resistance. As a result, early failure and poor functioning can occur, at least in certain applications of these backing materials in a nonreinforced state.

In a typical manufacturing process, a coated abrasive article, including the backing and abrasive coating, among other things, is made in a continuous web form and thereafter converted into a desired construction, such as a sheet, disc, belt, or the like. One of the most useful constructions of a coated abrasive article is an endless coated abrasive belt, i.e., a continuous loop of coated abrasive material. In order to form such an endless belt, the web form is typically cut into an elongate strip of a desired width and length. The ends of the elongate strip of the preformed sheet of coated abrasive article are then joined together to create a "joint" or a "splice".

Two types of arrangements of the free ends of an elongate discrete strip to be spliced are common in making an a spliced endless belt. These are the "lap" splice and the "butt" splice. By "lap" splice, it is meant that the two free ends of the elongate strip are respectively bevelled in a tapered manner such that the top end and the bottom end of the elongate strip can be positioned together in superposition to form a joint without causing a significant change in the overall thickness of the belt. In the lap splicing of a preformed sheet of coated abrasive article, this bevelling on the bottom end is typically accomplished by removing abrasive grains and material from the abrasive surface of the strip, and by removing part of the material from the backing or underside of the elongate strip as the top end of the splice. The bevelled ends are then overlapped and joined adhesively or mechanically.

For the "butt" splice, it is meant that the two free ends of the elongate strip are brought into a juxtaposed relationship with the end faces in confronting abutment at a juncture line for joinder. The bottom surface of the backing at each end of the elongate strip, such as a preformed sheet of coated abrasive article, typically is then coated with an adhesive, mechanical securement means or other attachment means and overlaid with a strong, thin, tear-resistant, splicing media.

However, the formation of a splice in a previously manufactured coated abrasive article sheet to provide an endless configuration thereof can be undesirable as a discontinuity is necessarily created in the abrasive coating layer at the outer surface, i.e., the abrasive coating surface, of the splice site. This type of splice is generally exemplified in U.S. Pat. Nos. 2,391,731 (Miller), 3,333,372 (Gianatsio) and 4,736,549 (Toillie). The discontinuity or splice area in the coated abrasive layer can cause a mark in a workpiece which is not consistent with the cut imparted in a workpiece surface by the unspliced remainder of the abrasive coating layer. These marks are referred to as "chatter".

Other background art includes:

U.S. Pat. No. 289,879 (Almond) pertains to a polishing tool comprising abrasive grains adhered to a tubular backing.

U.S. Pat. No. 2,012,356 (Ellis) discloses a coated abrasive having a seamless tubular fabric backing.

U.S. Pat. No. 2,404,207 (Ball) pertains to a seamless coated abrasive article having a fibrous nonwoven backing. The fibrous nonwoven backing can be saturated with an adhesive and contain other reinforcing fibers.

U.S. Pat. No. 2,411,724 (Hill) teaches a method for making an endless tubular coated abrasive, wherein a thermoplastic or thermosetting adhesive is extruded to form a backing, in which abrasive grains are embedded while the backing is molten. In another embodiment of that invention, the backing can comprise a liner of a reinforcing strands over which is the thermoplastic adhesive, which are ultimately spliced with the backing.

French Patent Application Publication No. 2,396,625 dated 2 February 1979 teaches a seamless endless coated abrasive belt that is made by the continuous weaving of a cloth backing. This published application also describes a spliced backing having a sinusoidal splice.

French Patent Publication 2,095,185 published 2 November 1972 (Ponthelet) discloses an abrasive product having a nonwoven backing which may be reinforced with filaments placed in either the transversal direction, longitudinal direction or as a grid form. Where the filaments are arranged only in one direction, the filaments are said to be maintained in a parallel arrangement as held down by a veil made of natural, artifical or synthetic fibers.

PCT Published Patent Application No. WO 93/12911 (Benedict et al.) published Jul. 8, 1993, pertains to a method of making a spliceless coated abrasive belt. The backing includes between about 40 to 99% by weight of an organic polymeric binder and an effective amount of a fibrous reinforcing material engulfed within the organic polymeric binder material. In a method of making the spliceless belt Benedict et al. includes preparing a loop of liquid binder material having fibrous reinforcing material therein around the periphery of a drum, and then solidifying the binder material to form the endless, spliceless belt.

In many abrading applications, it is desired to use an endless coated abrasive belt that has a backing with certain desired physical properties. These properties include relatively low stretch, relatively high tensile value and relatively high adhesion between the backing and the abrasive coating. Although the Benedict et al. application represents an advance in the art for making endless coated abrasive belts, there is room to explore alternate approaches to improve the physical properties of the backing.

U.S. application Ser. No. 08/079,364 filed 17 June 1993 (Schneider et al.) pertains to a method of making an endless, splice-less belt. A flowable organic material is spin casted to form an endless loop. After this spin casting, abrasive particles are inserted into the spin caster and the abrasive particles are engulfed into the organic material. The organic material is then solidified to form an endless, spliceless abrasive belt.

U.S. Pat. No. 2,349,365 (Martin et al.) involves a flexible coated abrasive article in which the backing comprises a sheet of plastic material reinforced with a sheet of cloth or paper.

U.S. Pat. No. 2,712,987 (Storrs et al.) teaches a coated abrasive in which the abrasive grains are embedded in a nylon backing. The coated abrasive containing the nylon backing, can be cut into two free ends and the two free ends joined by softening the nylon and then resolidifying.

U.S. Pat. No. 3,166,388 (Riegger et al.) discloses a coated abrasive backing comprising thermoplastic reinforcing fibers distributed throughout wood pulp fibers.

PCT published patent application No. WO 86/02306 publication dated 24 April 1986 (Hansen et al.) pertains to an improved coated abrasive backing having a flexible sheet and a multiplicity of weft free, closely spaced, stretch resistant, longitudinally aligned, coplanar, continuous filament reinforcing yarn bonded to one surface of the flexible sheet before the backing is seamed into an endless belt. However, the filament yarn is applied as a plurality of separate yarns, each of which would need to be spliced as well as the backing sheet. The filament yarn in Hansen et al. is not continuous in the sense that it continuously runs around the backing sheet from one lateral side of the backing sheet to the other. Therefore, if the abrasive article in Hansen et al. were formed into an endless configuration, the reinforcing effect of the yarn would be delimited by the strength of the spliced portion of each separate yarn.

U.S. Pat. No. 4,867,760 (Yarbrough) teaches a stitchbond fabric that consists of interlacing warp and fill yarns as a backing for coated abrasives.

U.S. Pat. No. 4,894,280 (Guthrie et al.) pertains to a flexible tear resistant sheet material comprising a web of thermoplastic microfibers with staple fibers homogeneously dispersed throughout.

U.S. Pat. No. 2,356,866 to Melton et al., and U.S. Pat. No. 2,333,035 to Oglesby disclose abrasive materials reinforced by fibrous webs.

U.S. application Ser. No. 07/903,360 (Goethel et al.) filed 24 June 1992 and assigned to the assignee of the current invention, teaches a phenolic resin for saturating a cloth backing for a coated abrasive article.

SUMMARY OF THE INVENTION

The present invention pertains to a method for making a coated abrasive article, and particularly to a method for making a coated abrasive article belt having an endless, spliced backing sheet reinforced by continuously applied unspliced fibrous strand or strip material, and the product of this method.

In one embodiment, the invention pertains to a method of making a flexible coated abrasive belt comprising the steps of:

(a) providing a backing sheet having opposite first and second major surfaces, opposite ends and a length having generally parallel side edges;

(b) providing a temporary support structure having a peripheral surface capable of supporting the backing sheet;

(c) joining the opposite ends at a splice to form a spliced endless backing sheet;

(d) deploying the first major surface of the backing sheet in contact with the peripheral surface;

(e) applying fibrous reinforcing material onto the second major surface of the spliced endless backing sheet in a plurality of revolutions around the spliced endless backing sheet in a path along the length;

(f) applying of a coating of a first binder precursor onto the fibrous reinforcing material in a quantity sufficient for the solidified binder precursor to bond said fibrous reinforcing material to the second major surface to form a reinforcing fiber layer;

(g) exposing the coating of first binder precursor applied in step (f) to conditions effective to solidify the first binder precursor to form an endless reinforced backing structure having opposite major surfaces corresponding respectively to the first major surface of the backing sheet and the reinforcing fiber layer; and (h) applying an abrasive coating comprising binder and abrasive particles on one of the first major surface or the fiber reinforcing layer thereby forming a coated abrasive belt. These steps can be performed sequentially or in variations thereof, such as described below.

For purposes of this invention, it will be understood that the backing sheet can be spliced off the temporary support structure and then later be deployed thereon followed by the applying of the fibrous reinforcing material on a surface thereof, or, alternatively, the backing sheet first can be deployed as a discrete sheet on the temporary support structure and then the opposite ends can be spliced on the support followed by the appyling of the fibrous reinforcing material. It also is to be understood that the application of the abrasive coating to a surface of the backing sheet alternatively can precede the steps of splicing the backing sheet and applying the fibrous reinforcing material to the opposite surface of the backing sheet within the scope of the invention. Also, the applying of the abrasive coating can be performed by forming the abrasive coating in-situ on either of the fiber reinforcing layer or the exposed surface backing sheet, or alternatively, the abrasive coating can be applied by laminating a preform thereof on one of these surfaces.

It is also within the scope of this invention to apply the binder precursor to the fibrous reinforcing material before, simultaneous to, or after the applying of the fibrous reinforcing material to a surface of the spliced backing sheet. It further is within the scope of the invention to use more than one binder precursor to apply the fibrous reinforcing material to the spliced backing sheet, such as by applying binder to the fibrous reinforcing material and the surface of the backing sheet to be contacted with same.

For purposes of this invention, the term "endless" means that the backing sheet used in the belt has no free ends along its length direction.

For purposes of this invention, the fibrous reinforcing material is applied to the spliced backing sheet in a "continuous" manner in the sense that it is constituted by at least one individual fibrous strand or narrow fibrous strip wrapped around the endless spliced backing sheet more than one complete revolution and over the splice without any disruptions in the cross-sectional integrity of the fibrous reinforcing material along its length.

For purposes of this invention, the terminology "splice", as used herein, encompasses either a "lap" or "butt" type of splice By "lap splice" it is meant that the two free ends of the elongate backing sheet are respectively bevelled in a tapered manner such that the top end and the bottom end of the elongate strip can be positioned together in superposition to form a joint without causing a significant change in the overall thickness of the belt. In the lap splicing of the elongate backing sheet, this bevelling on the bottom end is typically accomplished by removing material from upper side of the bottom end of the backing sheet, and by removing part of the material from the underside of the top end of the backing sheet. The bevelling is formed such that the respective ends taper down in thickness. It is preferred no significant increase in thickness, thus, the splice zone for a lap splice does not encompass overlapping portions of the free ends which would depart from and increase the thickness of the backing sheet from its original thickness.

For the "butt splice" it is meant that the two free ends of the elongate backing sheet are brought into a juxtaposed relationship with the end faces in confronting abutment for joinder. The bottom surface of the backing sheet at each end of the elongate backing sheet, can then in one embodiment, be coated with an adhesive and overlayed with a strong, thin, tear-resistant, splicing media. It is to be understood that the free ends of the backing can be joined over the juncture line of the splice by any convenient means, including adhesives, masking adhesive tape, mechanically fastening means such as clamps, clips or staples, and the like. The bottom surface of the backing sheet can be skived at the splice site such that a recess is formed to conformably house the splice media and splice adhesive to mitigate any increase in the thickness of the backing at the splice site. Preferably, the thickness of the spliced backing sheet of the present invention does not vary by more than 15% along the entire length of the sheet, inclusive of the. splice area. Alternatively for a butt splice, the two free ends are abutted to form a juncture line. The two free ends can be adhesively or mechanically held together. If it is mechanically fastened, the mechanical fastening means can be employed up until the reinforcing fiber is applied to the spliced backing sheet, and then the fastener can be removed. For the butt splice, a splice media is not always required. A splice adhesive may serve as the means to join the two free ends of the backing sheet and the reinforcing fiber serves to reinforce the entire belt length including the the splice area.

Advantageously, this invention provides or results in a coated abrasive article having at least one of the following improved properties: the backing sheet provides increased adhesion between the backing and the abrasive coating and/or the fiber reinforcing layer provides lower stretch or increased tensile strength in the backing. Obviously the actual values of these properties will depend in part of the selection of the raw materials employed. It is within the scope of this invention to select the appropriate raw materials to achieve the desired physical properties. It is to be understood that this invention encompasses the coated abrasive article product of this method, as well any other methods of the invention, described herein.

If there is less than desired adhesion between the backing and the second binder, shelling may occur. Shelling is the term used to describe the premature release of abrasive particles from the coated abrasive article. Shelling is generally undesirable because it reduces the useful life of the coated abrasive.

Further, the method of the invention also has the advantage that the loss strength associated with the splice in the backing sheet can be minimized or avoided by having the continuous fibrous reinforcing material applied over the splice joint. The method of the invention, in one embodiment, also provides a spliced endless fiber reinforced backing that then can be continuously coated with the abrasive coating along a surface thereof; thereby preventing the formation of splice artifacts and discontinuities in the coated abrasive surface.

The fiber reinforcing layer of the invention can be substantially completely surrounded by (i.e., engulfed within) the organic polymeric binder material. That is, the wound layer of fibrous reinforcing material is embedded or engulfed within the internal structure of the loop, i.e., within the body of the loop, such that there are regions of organic binder material free of wound fibrous reinforcing material on opposite surfaces of the layer of wound fibrous reinforcing material. In this way, the outer surfaces, e.g., the spliced backing sheet and the fiber reinforcing layer loop, have a generally smooth, uniform surface topology. That is, the outer and inner surfaces of the backing loop have a topology without any fibrous reinforcing material protruding from the surface. Furthermore, the surface topology is preferably free of any waviness that mirrors the fibrous reinforcing material. Alternatively, the reinforcing material can be wound with a wetting but not necessarily engulfing amount of resin in an amount sufficient to immobilize the fiber in place on the backing sheet after drying or curing.

In a more specific embodiment of the method of the invention, the applying of the reinforcing fiber onto the spliced backing sheet is executed in a manner to provide a spacing of about 2–50 strands per cm of lateral width of the second major surface of the endless backing sheet.

In a preferred embodiment of making the coated abrasive article of the invention, the embedding of the abrasive particles in the second binder precursor layer, i.e., the so-called make coat, involves applying the abrasive particles to the second binder precursor by a coating technique selected from the group consisting of electrostatic coating, drop coating, or magnetic coating.

In a further embodiment, the above method of making the coated abrasive article further includes the step of applying a third binder precursor layer, as a so-called size coat, onto the embedded particles and then solidifying same.

In one particular embodiment of the above-mentioned method, the manner of applying the fibrous reinforcing material comprises winding one individual fibrous reinforcing strand or narrow fibrous strip as a continuous element onto the spliced backing sheet around the periphery of the temporary support structure in the form of a helix extending longitudinally to form the fiber reinforcing layer in a manner which spans substantially the entire lateral width of said second major surface of said endless backing sheet, and preferably spans the entire width thereof. The fibrous strand or narrow strip windings can be applied side-by-side along the length of the surface of the backing sheet with their lateral edges in close proximity to provide a substantially continuous layer. This spiral winding of the reinforcing strand or strip on the preformed spliced backing imparts increased strength and decreased stretchability to the overall backing formed.

The strand material can comprise a number of different types of nonmetallic or metallic fibrous material, such as glass, steel, carbon, ceramic, wool, silk, cotton, cellulose, polyvinyl alcohol, polyamide, polyester, rayon, acrylic, polypropylene, and aramid.

In a preferred embodiment of the method of the invention, the manner of applying the fibrous reinforcing material comprises separately winding each of at least a first individual reinforcing fibrous strand and a second individual reinforcing fibrous strand onto a spliced backing sheet around the periphery of the temporary support structure in the form of a helix extending longitudinally to form the fiber reinforcing layer that spans substantially the entire lateral width of the second major surface of the endless backing sheet. The selection of different types of wound fiber strands can be used to provide an improved balance of physical properties in the fiber reinforcement. For instance, in a combination of glass and polyamide as the two different types of fiber strands, the glass strand imparts low stretch property while the polyamide offers strength to the fiber reinforcing layer. As another example, a combination of aramid and polyester strands provides a balance of strength/low stretch and resilience properties, respectively, in the fiber reinforcing layer. The reinforcing fiber material also can be a narrow fibrous strip, such as a strip of woven cloth or nonwoven, or a tow, having a lateral width less than the lateral width of the backing sheet to enable helically winding thereon. Further, the reinforcing fiber can be applied in separate subsets across the lateral width of the spliced backing sheet. For example, continuous reinforcing fiber can be wound in multiple windings at lateral sides of the spliced backing sheet and/or over a central area spaced from the side edges thereof.

In a further embodiment of the invention, the backing sheet is particularly selected from the group consisting of a polymeric film, a primed polymeric film, a woven cloth, a knitted cloth, paper, a vulcanized fiber sheet, a nonwoven, including combinations and treated versions thereof. For instance, in one embodiment, the backing sheet can be selected to be a fibrous reinforcing cloth structure, such as a woven or knitted cloth, and the cloth structure preferably is coated with a liquid organic binder material prior to being applied around the temporary support structure.

In another further embodiment of the invention, the temporary support structure is a drum. For example, a drum which is rotatable about its central axis by a motor drive and a drum which has an expandable and/or collapsible periphery to permit adjustment of its circumference to accommodate and correspond to the particular length of the spliced backing sheet is preferred.

Similar methods can also be used in preparing a coated abrasive backing using a support structure, such as a conveyor system. Such a system would typically use, for example, a stainless steel sleeve, in the form of a conveyor belt. In this embodiment, the step of preparing a fiber reinforced spliced backing includes preparing the backing around the conveyor belt.

Other constructions, embodiments, and features of the invention will become apparent from the following description of the drawings and preferred embodiments.

DETAILED DESCRIPTION OF THE PREFERRED EMBODIMENTS

Detailed descriptions of the present invention are provided herein. Therefore, the invention is not limited to the specific formulations, arrangements, and methods identified and described, except as limited by the claims.

Figure 1:
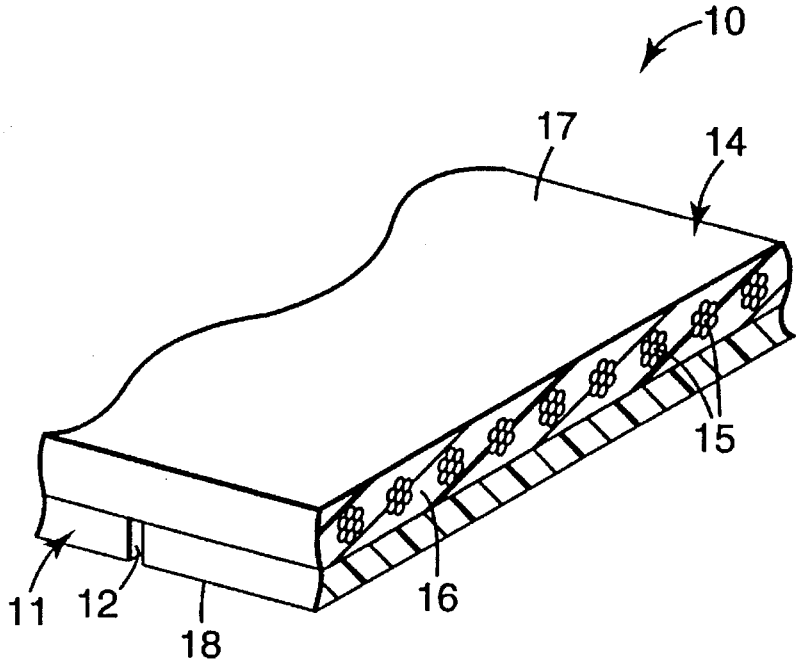
FIG. 1 is a perspective view of an enlarged fragment of a coated abrasive backing made by the method of the invention with edge surfaces revealing cross-sectional details.

Referring to FIG. 1, the reinforced spliced backing made by the method of the invention, which in turn is then used in making a coated abrasive article, is illustrated in FIG. 1. In FIG. 1, the coated abrasive backing 10 comprises a backing sheet 11 having a splice 12. Over the backing sheet 11 are reinforcing fibers 15 which are saturated with binder 16 to form fiber reinforcing layer 14. Binder 16 adheres the fibers 15 to the backing sheet 11. Abrasive particles are then adhered by methods, such as described hereinafter, to at least one of the exposed major surfaces 17 and 18 of the spliced backing 10, either on the side of the fibers 15 or the backing sheet 11.

The binder 16 is applied to the fibers 15 as a liquid state and solidified after the fibers 15 are applied to the backing sheet 11 by techniques described in greater detail hereinafter. Herein, the term "liquid" refers to a material that is flowable or flowing, whereas the term "solid" or "solidified" refers to a material that does not readily flow under ambient temperatures and pressures.

Figure 2:
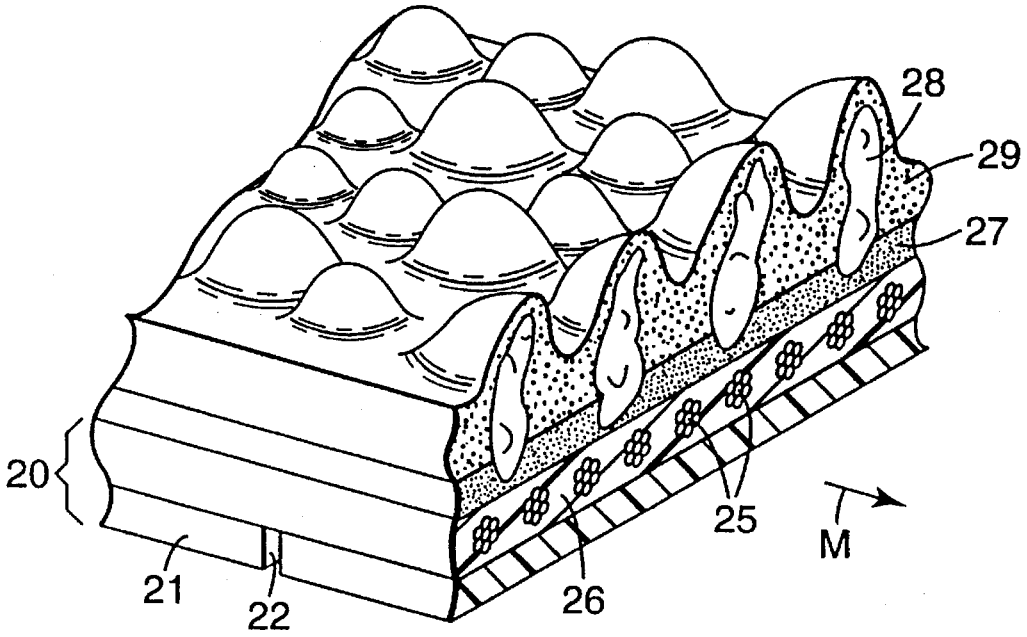
FIG. 2 is an enlarged fragmentary cross-sectional view of a coated abrasive article made by the method of the invention.

Referring to FIG. 2, the coated abrasive article comprises a backing 20 (backing 10) having a backing sheet 21 having a splice 22. In this embodiment, reinforcing fibers 25 which are saturated with binder 26 are placed adjacent the backing sheet 21. Over the reinforcing fibers 25, a make coat 27 is first applied, then abrasive particles 28 are embedded therein. A size coat 29 is then applied over abrasive particles 28. The machine direction M of the coated abrasive article is shown. FIG. 2 depicts the abrasive coating on the side of the backing having the reinforcing fibers; although it is to be understood that the abrasive coating alternatively, and preferably, can be provided on the side of backing sheet 21 opposite to the reinforcing fibers.

Figure 3:
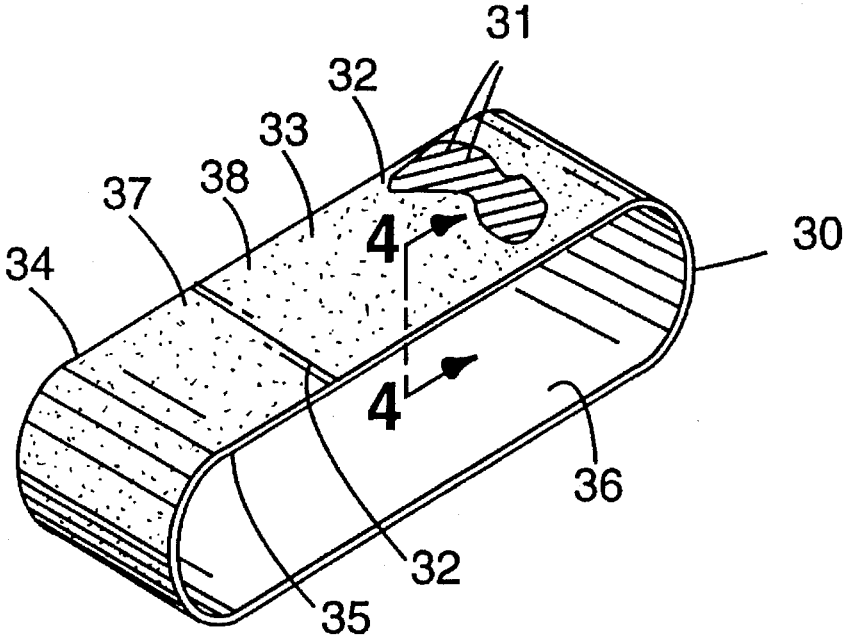
FIG. 3 is a perspective view of an endless coated abrasive article with a partial fragmentary view showing the reinforced spliced backing made by the method of the invention.

Referring to FIG. 3, a coated abrasive belt 30 of the invention is shown with reinforcing fibrous strand(s) 31, splice 32 and an abrasive coating 33 as the outer surface of the belt, such as comprised of features 27, 28 and 29 described for FIG. 2. The length of the belt is defined by generally parallel side edges 34 and 35. The length of the belt typically will extend in a machine direction of the belt. The reinforcing strand(s) 31 are embedded in a fiber reinforcing layer 36 extending along the length of the belt underside, The strands 31 extend in a plurality of revolutions following a path along the length of the belt between side edges 34 and 35 over an intervening backing sheet (shown in FIG. 4) located between the abrasive coating 33 and the fiber reinforcing layer 36. The belt 30 has opposite ends 37 and 38 which are joined at the splice 32.

Figure 4:
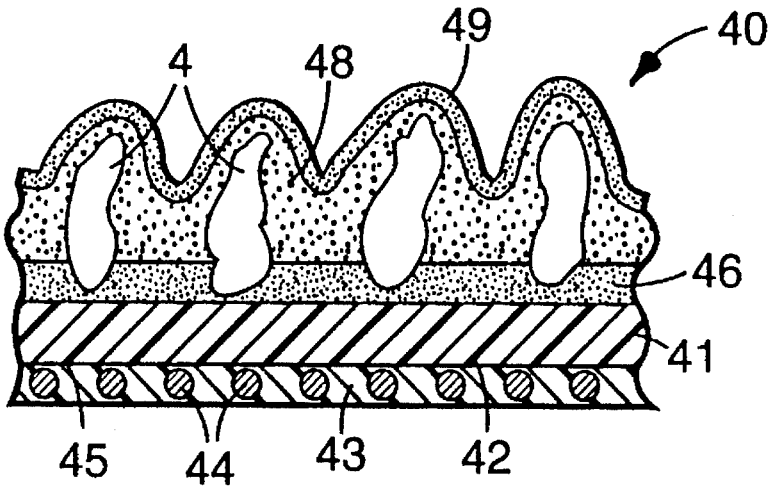
FIG. 4 is a partial cross-sectional view of a coated abrasive article made by the method of the invention taken along direction 4—4 in FIG. 3.

Referring to FIG. 4, taken in the direction shown in FIG. 3, shows a cross-sectional view of a coated abrasive article 40 made by the method of the invention with reinforced backing structure 41 composed of spliced backing sheet 42 and fiber reinforcing layer 43 with reinforcing strands 44 and binder 45, a make coat 46, abrasive particles 47, a size coat 48, and a supersize coat 49.

Although FIGS. 1–4 are representative of a coated abrasive belt, which is of a particularly advantageous construction or configuration, other shapes and forms are possible as well. For example, belts of the present invention can be in the form of a conical shape. The edges of the backing can also be smooth or scalloped.

Referring again to FIG. 4, the coated abrasive belt 40 can generally be of any size desired for a particular application. The length between the opposite ends, width, and thickness, can be of a variety of dimensions desired depending on the end use. For example, the length of the coated abrasive belt 40 can be any desired length. Typically, the length between the opposite ends is about 40–1000 centimeters (cm). This length will be equivalent to a circumferential length of the belt where the abrasive article has been spliced into endless form.

The thickness "$T_1$" of the endless reinforced backing structure 41, including spliced backing sheet 11 and reinforcing fiber layer 14, is typically between about 0.07 millimeter (mm) and about 1 cm for optimum flexibility, strength, and material conservation. Further, the thickness "$T_1$" of backing 41 preferably should not vary by more than about ±15% around the entire length of the belt 40 including the area of the splice. This defines a generally consistent and uniform coated abrasive belt of advantage. Although this variance refers to a variance along the thickness "$T_1$" of the backing 41, this variance also generally applies to a backing coated with adhesives and abrasive material, i.e., the thickness "T" of the belt 40.

Other aspects of the invention will become more apparent from the following more detailed description of the method of the invention.

Figure 5:
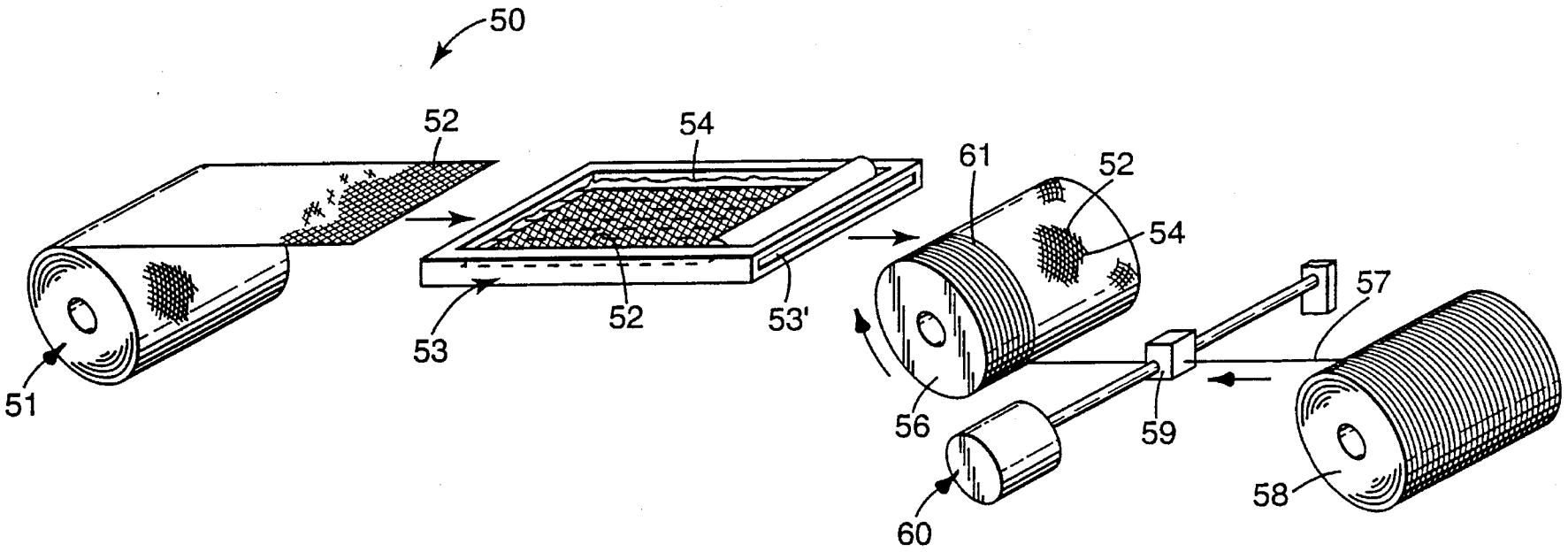
FIG. 5 is a perspective view of the major elements (without showing supporting structures) of an apparatus to practice a preferred process for making an endless spliced reinforced backing structure according to the present invention.

In this regard, FIG. 5 illustrates key components of an apparatus used in the process for making a coated abrasive backing according to the method of the invention. The fiber reinforced backing structure of the invention is made on an apparatus 50. A cloth backing web structure 52 is unwound from unwind station 51 and conveyed to a knife coater 53 containing a bath of resin where the web 52 is saturated with organic polymeric binder material 54 as it is removed from an unwind station 51. The amount of binder material applied is determined by a knife coater 53, in which a gap 53' controls the amount of polymeric binder material 54 applied. The rear end of the backing sheet is then cut perpendicular to the forward direction of the web to form an elongate discrete strip having two free ends as a backing sheet. The two free ends are brought into contact at the confronting faces of the ends, such as by manual arranging, and butt spliced by techniques described herein to form juncture 55 and an endless spliced backing sheet, referred to as spliced web/liquid binder composition (52/54).

The spliced web/liquid binder composition (52/54), i.e. the spliced impregnated backing web, is then applied to a temporary support drum 56 in a single layer wherein the circumference of the endless web/liquid binder composition (52/54) corresponds to the circumference of the drum.

Reinforcing fibers strands 57 leave an unwind station 58 and are wetted with liquid binder precursor material at level winder station 59. These saturated fibers are then applied onto the spliced web/liquid backing 52/54. The winding procedure involves the use of a strand guide system 60 with level winder 59. In this method, the drum 56, preferably, is rotated while the reinforcing fibrous strand 57 is initially attached to the spliced backing fitted to drum 56, and is pulled through the level winder 59, and is wound around the drum 56 helically or spirally across the width of the drum, such that the applied layer of the strand 61, upon completion of winding, is no wider than the layer of the web/binder layer 52/54.

It is preferred that the level winder 59 move across the width of the drum such that the continuous reinforcing fibrous strand 57 is uniformly applied in a layer across the width of the web 52. Thus, the strand 57 is in a helically wound pattern of a plurality of wraps in a layer within the organic polymeric binder material, with each wrap of the strand parallel to the previous wrap of the strand. Furthermore, the individual wraps of the strand 57 are at a constant nonzero angle relative to the parallel side edges of the web 52. The fiber reinforcing strands are wound onto web backing 52 with a spacing of about 2–50 strands per cm of width; although it is to be understood that a broader range of strand spacing is contemplated within the scope of the invention. The spacing selected can depend on a number of variables, such as the strand material(s), reinforcing strength needed as a function of the type of backing material selected and type of service intended for the coated abrasive articles, among others.

It is possible that several strands may be used to cover the entire width of the web backing in case that the strands have sufficient length to revolve more than once around the circumference of the backing web but are not sufficiently long to traverse the entire lateral width of the backing web.

Sufficient uncured resin 54 is applied to the web 52 to provide a layer of resin at least above and below the reinforcing fiber material therein, i.e., on the outer surfaces and sometimes even the interior of the cloth. The binder precursor material not only can be applied to the strands before winding, but, alternatively, it can be applied over web 52 after disposition on drum 56 before winding or over the previously wound strands, or in any combinations of these coating procedures to provide adhesion of the reinforcing strands 57 to the backing sheet. It is generally preferred that the binder precursor also saturate and engulf the reinforcing strands.

It is preferred that the binder precursor used to coat the strands is exposed to an energy source (not shown), either thermal energy or radiation energy. Further processing may then occur such as additional curing, flexing and/or humidification. After this optional further processing, the coated abrasive can be converted or slit into the desired form or shape.

The temporary support structure 56 used in such a method is preferably a drum, which can be made from a rigid material such as steel, metal, ceramics, or a strong plastic material. The material of which the drum is made should have enough integrity such that repeated endless loops can be made without any damage to the drum. The drum is placed on a mandrel so that it can be rotated at a controlled rate by a motor. This rotation can range anywhere from 1 to 100 revolutions per minute (rpm) depending on the application.

The drum can be a unitary or created of segments or pieces that collapse for easy removal of the endless, spliced backing loop. If a large endless, spliced backing loop is preferred, the drum is typically made of segments for collapsibility and easy removal of the loop.

The circumference of the drum will generally correspond to the inner length (circumference) of the endless, spliced backing sheet. The width of the endless, spliced loops can be of any value less than the width of the drum. A single endless, spliced loop can be made on the drum, removed from the drum, and the sides can be trimmed. Additionally, the loop can be slit longitudinally into multiple loops with each having a width substantially less than the original loop. The drum is usally a rotatable one in the practice of the invention. Although, it is also contemplated that the drum could be nonrotatable where the strand applying means is capable of travelling around the circumference of the drum.

In many instances, it is preferred that a release coating be applied to the periphery of the drum before the binder precursor or spliced backing sheet or any of the other components are applied. This provides for easy release of the endless, spliced loop after the binder is solidified. In most instances, this release coating will not become part of the endless, spliced loop. If a collapsible drum is used in the preparation of a large endless, spliced loop, such a release liner helps to prevent, or at least reduce, the formation of ridges in the inner surface of the loop, caused by seams or welds in the drum surface. Examples of such release coatings include, but are not limited to, waxes, silicone waxes or fluorochemicals, or polymeric films coated with silicone waxes or fluorochemicals. It is also within the scope of this invention to use a second release coating which is placed over the final or top coating of the binder. This second release coating is typically present during the solidification of the binder, and can be removed afterwards.

Alternatively, in the preparation of a coated abrasive article of the present invention, the reinforcing fiber layer can be applied to the spliced backing sheet supported around two drum rollers, which are connected to a motor for driving at least one of rollers to rotate the backing. Alternatively, the backing can be installed around one drum roller, which is connected to a motor for rotating the backing. As the backing rotates, the adhesive layers or abrasive slurry are applied by any conventional coating technique such as knife coating, die coating, roll coating, spray coating, or curtain coating. Spray coating is preferred for certain applications.

After applying the fibrous reinforcing material to the spliced backing sheet and curing the binder precursor, in this embodiment, the resulting backing is removed from the temporary drum, and then the abrasive coating is applied to either of the fiber reinforcing layer or the opposite side of the spliced backing sheet. The fiber reinforced backing must be turned inside out (everted) to expose the opposite surface of the spliced backing sheet, i.e., the side of the backing sheet opposite to the fiber reinforcing layer, if the abrasive coating is to be applied to that surface. Either way, the fiber reinforced backing is again temporarily supported on any convenient support means such as either a drum or at least two cantilevered idler rolls for application of an abrasive slurry or abrasive coating (sequential coating of make coat and abrasive particles).

If an abrasive slurry is not used, i.e., if the abrasive material is applied after a second or make adhesive layer is applied, the abrasive grains can be electrostatically deposited onto the adhesive layer by an electrostatic coater. The drum roller acts as the ground plate for the electrostatic coater. Alternatively, the abrasive grains can be applied by mineral drop coating or magnetic coating.

Preferably, the make coat layer is solidified, or at least partially solidified, after embedding the abrasive particles, and then a size coat layer (and optionally a supersize coat) is applied. The size coat adhesive layer can be applied by any conventional method, such as roll coating, spray coating, or curtain coating. The size coat is preferably applied by spray coating. The make and size coats layer(s) can then be fully solidified while the backing is still on the drum rollers. Alternatively, the resulting product can be removed from the drum rollers prior to solidification of the adhesive layer(s).

Examples of the specific materials employed in the method and coated abrasive product of the invention are described in greater detail hereinafter.

The coated abrasive articles of the present invention include a fiber reinforced backing structure with the following properties. The reinforced backing structure is sufficiently heat resistant under grinding conditions for which the abrasive article is intended to be used such that the backing does not significantly disintegrate, i.e., split, break, delaminate, tear, or a combination of these, as a result of the heat generated during a grinding, sanding, or polishing operation. The reinforced backing structure is also sufficiently tough such that it will not significantly crack or shatter from the forces encountered under grinding conditions for which the abrasive article is intended to be used. That is, it is sufficiently stiff to withstand typical grinding conditions encountered by coated abrasive belts, but not undesirably brittle.

Preferably, the reinforced backing structures, and spliced endless coated abrasive belts incorporating same, of the present invention are sufficiently flexible to withstand grinding conditions. By "sufficient flexibility" and variants thereof in this context, it is meant that the reinforced backing structures, and spliced endless coated abrasive belts, will flex or bend under typical grinding conditions and return to their original shape without significant permanent deformation. For example, a continuous "flexible" backing loop (and endless abrasive belt incorporating same) is one that is sufficiently flexible to be used on a two (or more) roller mount or a two (or more) pulley mount in a grinder. Furthermore, for preferred grinding applications, the reinforced backing structure (and the endless abrasive belt incorporating same) is capable of flexing and adapting to the contour of workpiece being abraded, yet is sufficiently strong to transmit an effective grinding force when pressed against the workpiece.

Preferred reinforced backing structures of the present invention possess a generally uniform tensile strength in the longitudinal, i.e., machine direction. This is typically because the fibrous reinforcing material extends along the entire length of the backing sheet and there is no seam in the continuous fibrous reinforcing material. More preferably, the tensile strength for any portion of a reinforced backing structure tested does not vary by more than about 20% from that of any other portion of the reinforced backing structure. Tensile strength is generally a measure of the maximum stress a material subjected to a stretching load can withstand without tearing.

Preferred reinforced backing structures of the present invention also exhibit appropriate shape control and are sufficiently insensitive to environmental conditions, such as humidity and temperature. By this it is meant that preferred reinforced backing structures of the present invention possess the above-listed properties under a wide range of environmental conditions. Preferably, the reinforced backing structures possess the above-listed properties within a temperature range of about 10°–30° C., and a humidity range of about 30–50% relative humidity (RH). More preferably, the reinforced backing structures possess the above-listed properties under a wide range of temperatures, i.e., from below 0° C. to above 100° C., and a wide range of humidity values, from below 10% RH to above 90% RH.

The reinforced backing structures should also be able to withstand the grinding conditions and environments to which the coated abrasive article product is intended.

Backing Sheet

The preferred backing sheet material used in coated abrasive belts of the present invention is generally chosen such that there will be compatibility with, and good adhesion to, the adhesive layers, particularly to the make coat. Good adhesion is determined by the amount of "shelling" of the abrasive material. Shelling is a term used in the abrasive industry to describe the undesired, premature, release of a significant amount of the abrasive material from the backing. Although the choice of backing sheet material is important, the amount of shelling typically depends to a greater extent on the choice of adhesive and the compatibility of the backing sheet and adhesive layers and grinding conditions.

The backing sheet is comprised of an elongate web to be spliced to the desired backing length, then, reinforced by continuously wound fibrous material, such as yarn, described herein. The backing sheet is a web that can be chosen from any known abrasive backing subject to the following general requirements.

Examples of materials useful as backing sheets in this invention include polymeric film, primed polymeric film, cloth (woven and knitted),paper, vulcanized fiber, nonwovens, and treated versions thereof, and combinations thereof. The preferred backing sheet for this present application is cloth. It is preferred that there be only one integral layer constituting the backing sheet of this invention to produce a thinner total backing as reinforced by the wound yarn. However, more than one layer is also possible.

The preferred backing sheet of the invention is a cloth backing sheet. The cloth is composed of yarns in the warp direction, i.e., the machine direction, and yarns in the fill direction, i.e. the cross direction. The cloth backing sheet can be a woven backing, a stitchbonded backing, or a weft insertion backing. Examples of woven constructions include sateen weaves of 4 over one weave of the warp yarns over the fill yearns; twill weave of 2 or 3 over one weave; plain weave of one over one weave; and a drill weave of two over two weave. In a stitchbonded fabric or weft insertion backing, the warp and fill yarns are not interwoven, but are oriented in two distinct directions from one another. The warp yarns are laid on top of the fill yarns and secured to another by a stitch yarn or by an adhesive.

The yarns in the cloth backing sheet can be natural, synthetic or combinations thereof. Examples of natural yarns include cellulosic yarns such as cotton, hemp, kapok, flax, sisal, jute, carbon, manila, and combinations thereof. Examples of synthetic yarns include polyester yarns, polypropylene yarns, glass yarns, polyvinyl alcohol yarns, polyimide yarns, aromatic polyamide yarns, rayon yarns, nylon yarns, polyethylene yarns and combinations thereof. The preferred yarns of this invention are polyester yarns, nylon yarns, a mixture of polyester and cotton, rayon yarns, and aromatic polyamide yarns.

The cloth backing sheet can be dyed and stretched, desized or heat stretched. Additionally the yarns in the cloth backing can contain primers, dyes, pigments or wetting agents. The yarns can be twisted or texturized.

Polyester yarns are formed from a long chain polymer made from the reaction of an ester of dihydric alcohol and terephthatlic acid; preferably this polymer is a linear polymer of poly(ethylene terephthalate). There are three main types of polyester yarns: ring spun, open end and filament. A ring spun yarn is made by continuously drafting a polyester yarn, twisting the yarn and winding the yarn on a bobbin. An open end yarn is made directly from a sliver or roving. A series of polyester rovings are opened and then all of the rovings are continuously brought together in a spinning apparatus to form a continuous yarn. A filament yarn is a long continuous fiber; a filament yarn typically has a very low or non-existent twist to the polyester fiber.

The denier of the fibers should be less than about 2000, preferably between about 100 to 1500. The yarn size should range from about 1500 to 12,000 meters/kilogram. For a coated abrasive cloth backing, the weight of the greige cloth, i.e., the untreated cloth, will range from about 0.15 to 1 $kg/m^2$, preferably between about 0.15 to 0.75 $kg/m^2$. The cloth backing should also have a high surface area.

The coated abrasive backing may have an optional saturant resin coat, presize coat and/or backsize coat. If the backing sheet is a cloth backing sheet, at least one of these coats is required. The purpose of these coats is to seal the backing sheet and/or protect the yarns or fibers in the backing sheet. The addition of the presize coat or backsize coat may additionally result in a "smoother" surface on either the front or back side of the backing sheet. Further disclosure of treating cloth backing sheets can be found in U.S. Ser. No. 07/903,360 (Goethel et al.) incorporated herein after by reference.

After any one of the saturant coat, backsize coat or presize coat is applied to the backing sheet, the resulting backing sheet can be heat treated or calendered. The heat treating can be done as the binder precursor is at least partially solidified by placing the backing in a tenter frame which is in an oven. Additionally the backing can be processed through heated hot cans. The calendering step will remove some surface roughness and typically increase the surface smoothness. One preferred backing sheet is a woven cloth backing treated with a resole phenolic resin blended with a latex resin.

Examples of latex resins that can be mixed with the phenolic resin to treat the cloth backing include acrylonitrile butadiene emulsions, acrylic emulsions, butadiene emulsions, butadiene styrene emulsions and combinations thereof. These latex resins are commercially available under various tradenames from a variety of different sources including: "RHOPLEX" and "ACRYLSOL" commercially available from Rohm and Haas Company, "FLEXCRYL" and "VALTAC" commercially available form Air Products & Chemicals Inc., "SYNTHEMUL" and "TYLAC" commercially available from Reichold Chemical Co., "HYCAR" and "GOODRITE" commercially available from B.F. Goodrich, "CHEMIGUM" commercially available from Goodyear Tire and Rubber co., "NEOCRYL" commercially available from ICI, "BUTAFON" commercially available from BASF, and "RES" commercially available from Union Carbide.

The backing sheet may additionally comprise other optional materials, such as additives selected from the group consisting of fillers, fibers, antistatic agents, lubricants, wetting agents, surfactants, pigments, dyes, coupling agents, plasticizers, and suspending agents, such as those described for backings in PCT Published Application No. WO 93/12911 published 8 July 1993 (Benedict et al.). The amounts of these materials are selected to provide the properties desired.

Prior to reinforcement by the winding of the fibrous reinforcement material thereon, the backing sheet or web can be spliced by any known splice method, including those disclosed in U.S. Pat. Nos. 2,391,731 (Miller et al.), 3,729,873 (Sandell), and 4,018,574 (Dyer), and U.S. Ser. No. 08/078,484 (Gorsuch et al.) filed 16 June 1993, all of which are incorporated herein by reference. In general, the thickness of the backing at the splice area should be within ±15% of the thickness of unspliced areas of the backing sheet. It is preferred that the splice is formed close to so-called "zero caliper"; in other words, the thickness of the splice area is made approximately the same as the thickness of the rest of the belt. The spliced backing sheet typically represents about 20 to 40% by weight of the total backing weight.

Fibrous Reinforcing Material

The fibrous reinforcing material used in the invention to reinforce the preformed spliced backing sheet preferably is in the form of individual fibrous strands. Alternatively, the material can be a narrow fibrous strip having a lateral width less than that of the backing sheet, such as in a preferred ratio of 1/100 to 10/100.

Suitable fibrous strands for this invention are commercially available as threads, cords, yarns, rovings, and filaments. Threads and cords are typically assemblages of yarns. A thread has a very high degree of twist with a low friction surface. A cord can be assembled by braiding or twisting yarns and is generally larger than a thread. A yarn is a plurality of fibers or filaments either twisted together or entangled. A roving is a plurality of fibers or filaments pulled together either without a twist or with minimal twist. A filament is a continuous fiber. Both roving and yarns are composed on individual filaments. A fiber mat or web consists of a matrix of fibers, i.e., fine thread like pieces with an aspect ration of at least about 100:1. The aspect ratio of a fiber is the ratio of the longer dimension of the fiber to the shorter dimension.

In general, the fibrous reinforcing material can be composed of any material that increases the strength of the backing and/or prevents stretch. Examples of useful reinforcing fibrous material in applications of the present invention include metallic or nonmetallic fibrous material, with the preferred being nonmetallic. The nonmetallic fibrous materials may be materials made of glass including "FIBERGLASS" carbon minerals, synthetic or natural heat resistant organic reinforcing materials, or ceramic materials. Preferred fibrous reinforcing materials for the present invention are organic materials, glass, and ceramic fibrous material. Useful natural organic fibrous materials include wool, silk, cotton, or cellulose. Examples of useful synthetic organic fibrous materials are made from polyvinyl alcohol, nylon, polyester, rayon, polyamide, acrylic, polyolefin, aramid, or phenol. The preferred organic fibrous material for applications of the present invention is aramid fibrous material. Such a material is commercially available from Dupont Co., Wilmington, Del. under the trade names of "KEVLAR" and "NOMEX". It is also possible to have more than one type of reinforcing fiber in the backing construction. Generally, any ceramic fibrous reinforcing material is useful in applications of the present invention. An example of a ceramic fibrous reinforcing material suitable for the present invention is "NEXTEL" is commercially available from 3M Company, St. Paul, Minn.

The strands used in the present invention have relatively low residual "Z" or "S" twist characteristic as wound on the spliced backing sheet such as about 1.0 to 1.5 twist/cm.

It is possible to use more than one type of reinforcing fiber in this construction. Different fibers, such as "FIBERGLASS" and nylon, or "FIBERGLASS" and polyester, or aramid and nylon, or aramid and polyester, can be used in combination as the types of strand material by alternate winding of each type across the width of the preformed spliced backing, either in the same winding direction or in a criss-cross type winding. The different fibers used should be chosen for their desirable properties, such as low stretch for fiberglass and high strength for nylon. It is also possible to co-twist 2 or more strands together, the strands being the same or different in any of composition, denier, twist and so forth, and then apply the resulting yarn to the spliced backing as a single strand. The different strands can be selected to contribute different desired physical properties to the composite co-twisted fiber to provide a balance of properties.

The reinforcing fibers may contain a pretreatment of some kind, prior to being incorporated into the backing. This pretreatment may be an adhesion promoter or a slashing compound. For example, the fiberglass reinforcing fibers may contain a surface treatment, such as an epoxy or urethane compatible fiberglass yarn to promote adhesion to the make coat. Examples of such fiberglass yarns are "930" fiberglass yarns from PPG, Pittsburgh, Penn., and "603" fiberglass yarns from Owens-Corning, Toledo, Ohio. Useful grades of such glass yarns and rovings are in the range of about 150 to 32,000 meters/kg, which are also preferred.

If glass fibrous reinforcing material is used, it is preferred that the glass fibrous material be accompanied by an interfacial binding agent, i.e., a coupling agent, such as a silane coupling agent, to improve adhesion to the organic binder material, particularly if a thermoplastic binder material is used. Examples of silane coupling agents include "Z-6020" or "Z-6040" both available from Dow Corning Corp., Midland, Mich.

It is required that the fibrous reinforcing material is of a length sufficient to extend around the length, i.e., circumference, of the coated abrasive loop a plurality of times and provide at least one distinct layer of fibrous reinforcing material. In other words, the fibrous reinforcing material is of a length sufficient to place the strand in a helically wound pattern of a plurality of wraps in a layer within the organic polymeric binder material, with each wrap of the strand parallel to and in contact with the previous wrap of the strand. This helix generally and preferably extends longitudinally along the entire length of the backing loop. That is, each wrap of the strand approaches a parallel position relative to the side edges of the loop, although no individual wrap exactly parallels the side edges. Rather, the wraps are preferably at a constant, substantially nonzero angle relative to the parallel side edges of the spliced backing sheet or web.

The reinforcing fiber denier, i.e., degree of fineness, for preferred fibrous reinforcing material ranges from about 5 to about 5000 denier, typically between about 50 and about 2000 denier. More preferably, the fiber denier will be between about 200 and about 500. It is understood that the denier is strongly influenced by the particular type of fibrous reinforcing material employed.

It is possible in this invention that there are provided distinct regions of the composite backing (spliced backing sheet/reinforcing layer) that do not have fibrous reinforcing material therein. This results in one area of the backing having a greater ratio of fibrous reinforcing material to organic polymeric binder material than another area. For example, the fibrous reinforcing material can be entirely located within a region in the lateral sides and/or the central area of the backing layer 14 such that some outer edges thereof would be substantially uncovered by fibrous reinforcing material. This embodiment may not be acceptable in all cases as it may create an uneven surface on the backing.

In reinforcing the spliced backing sheet or web, the fibrous reinforcing material is applied onto the spliced backing sheet which is temporarily held on a support structure described herein, such as a drum structure. The binder precursor can be applied first to the spliced backing sheet, followed by winding of the reinforcing material. Alternatively, the reinforcing material can be applied first to the spliced backing sheet, followed by the binder precursor. In a third embodiment, the reinforcing material can be first saturated with the binder precursor and then applied to the spliced backing sheet. Thus, the binder precursor can be applied sequentially or simultaneously with the reinforcing material. It is also within the scope of this invention to use a combination of any of these three previous methods.

It is also within the scope of the invention to use a nonwoven sheet in combination with the reinforcing fibers. The nonwoven sheet, in some instances, can increase the tear strength of the resulting backing. It is contemplated for instance, that a nonwoven sheet is first saturated with a first binder precursor and applied over the second surface of the backing sheet. Next, the reinforcing yarns are applied on top of the saturated nonwoven sheet. The first binder precursor will wet the reinforcing yarns and bond the reinforcing yarns to the backing sheet.

It is also within the scope of the invention to use a substrate placed over the reinforcing fibers. The resulting backing will have the reinforcing fibers sandwiched between the backing sheet and this second substrate. The second substrate can be any material as described above regarding the backing sheet material. The purpose of the second subtrate may be: a more uniform backing surface, minimized wear of the reinforcing fibers, more platen compatible backing, increased stiffness of the resulting backing, and/or reduced the stretch of the resulting backing. In this embodiment, with the reinforcing fibers sandwiched between the two substrates, the reinforcing fibers will still reduce the stretch and increase tensile of the resulting backing. It is within the scope of this invention to use the proper selection of materials and amount to obtain the desired physical properties.

In one aspect of the invention, the reinforcing fibers are applied to a backing sheet already containing an abrasive coating. In this aspect, the backing sheet is turned inside out, i.e., the abrasive coating faces the support drum and the reinforcing fibers are applied to the backing sheet surface opposite the abrasive coating. After the reinforcing fibers are applied and the binder precursor is solidified, the resulting endless belt is essentially turned inside out to form the endless coated abrasive article.

The resulting endless abrasive belt article of the invention comprises a backing having a spliced backing sheet and a plurality of reinforcing fibers continuously present over all or lateral portions of the spliced area. It is generally preferred that the reinforcing fibers be parallel and non-interlacing as applied upon the spliced backing sheet. It is also within the scope of this invention that the reinforcing fibers are continuous over the entire lateral width of the spliced backing sheet, i.e., there is no substantial break or gap in the spacing of the reinforcing fibers across the width of the backing sheet. It is understood that the reinforcing fiber will have a starting end and a tail end with the intervening length of the fiber continuous in at least more than one revolution around the spliced backing sheet.

While the use of preformed fibers are preferred as the fibrous reinforcing material, the use of monofilament thermoplastic and thermoelastic beads extruded and cooled in-situ as helical windings over the spliced backing sheet are also contemplated.

Binder Precursor Material for Reinforcing Fibers

The binder precursor material used for securing the fibrous reinforcing material strands or narrow strips can be selected from a wide variety of binder materials which can be applied in liquid form and later solidified. Typically, the amount of binder precursor, which is an organic polymeric binder material, used to saturate the wound reinforcing fibers 15 in backing 41 is within a range of about 40–99 wt %, more preferably within a range of about 65–92 wt %, and most preferably within a range of about 70–85 wt %, based on the total weight of the fiber reinforcing layer alone. Although there can be additional components added to the organic polymeric binder material, the remainder of the typical, preferred, backing is primarily fibrous reinforcing material with few, if any, voids throughout the cured backing structure.

The binder material used to secure the wound reinforcing material in the fiber reinforcing layer is an organic polymeric binder material. It can be a cured or solidified thermosetting resin, thermoplastic material, or elastomeric material. Preferably, the organic polymeric binder material is a cured or solidified thermosetting resin. It is preferred that the binder material is a thermosetting resin, at least because such resins can be provided in a very fluid (low viscosity) flowable form when uncured, even under ambient conditions. Herein, the phrase "ambient conditions" and variants thereof refer to room temperature, i.e., 15°–30° C., generally about 20°–25° C., and 30–50% relative humidity, generally about 35–45% relative humidity.

If the organic polymeric binder material of the backing includes a curable thermosetting resin, prior to the manufacture of the backing, such as for wetting the reinforcing fibers 15 and/or for impregnating a cloth backing web 11 with a binder precursor, the thermosetting resin is in a nonpolymerized state, typically in a liquid or semiliquid state. During the manufacturing process, the thermosetting resin is cured or polymerized to a solid state. Depending upon the particular thermosetting resin employed, the thermosetting resin can use a curing agent or catalyst. When this curing agent is exposed to an appropriate energy source (such as thermal energy or radiation energy) the curing agent will initiate the polymerization of the thermosetting resin.

Examples of thermosetting resins from which the backing can be prepared include phenolic resins, amino resins, polyester resins, aminoplast resins, urethane resins, melamine-formaldehyde resins, epoxy resins, acrylated isocyanurate resins, urea-formaldehyde resins, acrylate resins and mixtures of isocyanurate resins, acrylated urethane resins, acrylated epoxy resins, or mixtures thereof. The preferred thermosetting resins are urethane resins, acrylate resins, epoxy resins, acrylated urethane resins, polyester resins, or flexible phenolic resins, and mixtures thereof. The most preferred resins are urethane resins, acrylate resins, epoxy resins, acrylated urethane resins, and mixtures thereof, because they exhibit an acceptable cure rate, flexibility, good thermal stability, strength, and water resistance.

One preferred class of binder material is polyurethane elastomer. Examples of such polyurethane materials are commercially available from Uniroyal Chemical under the trade designation "VIBRATHANE". These polyurethane elastomers are formed from prepolymers that can be a polyether based upon toluene diioscyanate terminated prepolymer or a polyether based upon diphenylmethane diisocyanate. These prepolymers can be crosslinked with 4,4"-methylene-bis-(orthochloroaniline) or a diamine curative. The polyurethane binders are also preferred, because during thermal curing the polyurethane resins do not appreciably reduce their viscosity and thus do not appreciably flow during curing. It is also within the scope of this invention to blend polyurethane resins with epoxy resins and acrylate resins.

Phenolic resins are usually categorized as resole or novolac phenolic resins. Examples of useful commercially available phenolic resins are "VARCUM" from BTL Specialty Resins Corporation, Blue Island, Ill.; "AROFENE" from Ashland Chemical Company, Columbus, Ohio; "BAKELITE" from Union Carbide, Danbury, Conn.; and "RESINOX" from Monsanto Chemical Company, St. Louis, Mo.

Resole phenolic resins are characterized by being alkaline catalyzed and having a molar ratio of formaldehyde to phenol of greater than or equal to 1:1. Typically, the ratio of formaldehyde to phenol is within a range of about 1:1 to about 3:1. Examples of alkaline catalysts useable to prepare resole phenolic resins include sodium hydroxide, potassium hydroxide, organic amines, or sodium carbonate.

Novolac phenolic resins are characterized by being acid catalyzed and having a molar ratio of formaldehyde to phenol of less than 1:1. Typically, the ratio of formaldehyde to phenol is within a range of about 0.5:1 to about 0.8:1. Examples of the acid catalysts used to prepare novolac phenolic resins include sulfuric, hydrochloric, phosphoric, oxalic, or p-toluenesulfonic acids. Although novolac phenolic resins are typically considered to be thermoplastic resins rather than thermosetting resins, they can react with other chemicals (e.g., hexamethylenetetraamine) to form a cured thermosetting resin.

Epoxy resins useful in the polymerizable mixture used to prepare backings of this invention include monomeric or polymeric epoxides. Useful epoxy materials, i.e., epoxides, can vary greatly in the nature of their backbones and substituent groups. Representative examples of acceptable substituent groups include halogens, ester groups, ether groups, sulfonate groups, siloxane groups, nitro groups, or phosphate groups. The weight average molecular weight of the epoxy-containing polymeric materials can vary from about 60 to about 4000, and are preferably within a range of about 100 to about 600. Mixtures of various epoxy-containing materials can be used in the compositions of this invention. Examples of commercially available epoxy resins include "EPON" from Shell Chemical, Houston, Tex.; and "DER" from Dow Chemical Company, Midland, Mich.

Examples of commercially available urea-formaldehyde resins include "UFORMITE" from Reichhold Chemical, Inc., Durham, N.C.; "DURITE" from Borden Chemical Co., Columbus, Ohio; and "RESIMENE" from Monsanto, St. Louis, Mo. Examples of commercially available melamine-formaldehyde resins include "UFORMITE" from Reichhold Chemical, Inc., Durham, N.C.; and "RESIMENE" from Monsanto, St. Louis, Mo. "RESIMENE" is used to refer to both urea-formaldehyde and melamine-formaldehyde resins.

Examples of aminoplast resins useful in applications according to the present invention are those having at least one pendant alpha, beta-unsaturated carbonyl groups per molecule, which are disclosed in U.S. Pat. Nos. 4,903,440 and 5,236,472, incorporated herein by reference.

Useable acrylated isocyanurate resins are those prepared from a mixture of: at least one monomer selected from the group consisting of isocyanurate derivatives having at least one terminal or pendant acrylate group and isocyanate derivatives having at least one terminal or pendant acrylate group; and at least one aliphatic or cycloaliphatic monomer having at least one terminal or pendant acrylate group. These acrylated isocyanurate resins are described in U.S. Pat. No. 4,652,274, which is incorporated herein by reference.

Ethylenically unsaturated resins include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacryate pentaerythritol triacrylate, pentaerythritol methacrylate, tetraacrylate. Other ethylenically unsaturated resins include monoallyl, polyallyl, and polymethallyl esters and diallyl adipate, and N,N-diallyladkipamide. Still other nitrogen containing compounds include tris(2-acryloyl-oxyethyl) isocyanuratel, 1,3,5-tri(2-mehtyacryloxyethyl)-striazine, acrylamide, methlacrylamide, N-methylacrylamide, N-N-dimethylacrylamide, N-vinylpyrrolidone, and N-vinylpiperidone.

Acrylate urethanes are diacrylate esters of hydroxy terminated NCO extended polyesters or polyethers. Examples of commercially available acrylated urethanes include "UVITHANE 782", available from Morton Thiokol Chemical, and "CMD 6600", "CMD 8400", and "CMD 8805", available from Radcure Specialties.

The acrylated epoxies are diacrylate esters, such as the diacrylate esters of bisphenol A epoxy resin. Examples of commercially available acrylated epoxies include those having the trade names "EBECRYL 3500", "EBECRYL 3600", and "EBECRYL 8805", available from Radcure Specialties, Atlanta, Ga.

Suitable thermosetting polyester resins are available as "E-737" or "E-650" from Owens-Corning Fiberglass Corp., Toledo, Ohio. Suitable polyurethanes also are available as "VIBRATHANE" B-813 prepolymer or "ADIPRENE" BL-16 prepolymer used with "CAYTUR"-31 curative. All are available from Uniroyal Chemical, Middlebury, Conn.

As indicated previously, in some applications of the present invention, a thermoplastic binder material can be used to bond the reinforcing fibers wound to the backing sheet, as opposed to the preferred thermosetting resins discussed above. A thermoplastic binder material is a polymeric material that softens when exposed to elevated temperatures and generally returns to its original physical state when cooled to ambient temperatures. During the manufacturing process, the thermoplastic binder is heated above its softening temperature, and often above its melting temperature, to be in a flowable state. After the reinforced fibers are bonded to the backing sheet, the thermoplastic binder is cooled and solidified.

Preferred thermoplastic materials of the invention are those having a high melting temperature and/or good heat resistant properties. That is, preferred thermoplastic materials have a melting point of at least about 100° C., preferably at least about 150° C. Additionally, the melting point of the preferred thermoplastic materials is sufficiently lower, i.e., at least about 25° C. lower, than the melting temperature of the reinforcing material. In this way, the reinforcing material is not adversely effected during the melting process of the thermoplastic binder.

Examples of thermoplastic materials suitable for preparations of backings in articles according to the present invention include polycarbonates, polyetherimides, polyesters, polysulfones, polystyrenes, acrylonitrilebutadiene-styrene block copolymers, polypropylenes, acetal polymers, polyamides, polyvinyl chlorides, polyethylenes, polyurethanes, or combinations thereof. Of this list, polyamides, polyurethanes, and polyvinyl chlorides are preferred, with polyurethanes and polyvinyl chlorides being most preferred.

If the thermoplastic material from which the backing is formed is a polycarbonate, polyetherimide, polyester, polysulfone, or polystyrene material, a primer can be used to enhance the adhesion between the fiber reinforcing layer and the make coat, if the make coat is chosen to be applied on that side of the backing. The term "primer" is meant to include both mechanical and chemical type primers or priming processes. This is not meant to include a layer of cloth or fabric attached to the surface of the backing. Examples of mechanical primers include, but are not limited to, corona treatment and scuffing, both of which increase the surface area of the surface. An example of a chemical primer is a colloidal dispersion of, for example, polyurethane, acetone, a colloidal oxide of silicon, isopropanol, and water, as taught by U.S. Pat. No. 4,906,523, which is incorporated herein by reference.

Although priming of a surface can involve scuffing, i.e., roughening up to increase the surface area of the surface, the surface of the backing is still relatively "smooth" as defined above. That is, the surface topology is generally smooth and flat such that there is little, if any, exposed, i.e., protruding, fibrous reinforcing material. Preferably, the surface topology is generally not effected by the fibrous reinforcing material within the organic polymeric binder material such that it would mirror the underlying topology of the fibrous reinforcing material.

A third type of binder useful in the saturating the reinforcing fibers of the present invention is an elastomeric material. An elastomeric material, i.e., elastomer, is defined as a material that can be stretched to at least twice its original length and then retract very rapidly to approximately its original length, when released. Examples of elastomeric materials useful in applications of the present invention include styrene-butadiene copolymers, polychloroprene (neoprene), nitrile rubber, butyl rubber, polysulfide rubber, bis-1,4-polyisoprene, ethylene-propylene terpolymers, silicon rubber, or polyurethane rubber. In some instances, the elastomeric materials can be crosslinked with sulfur, peroxides, or similar curing agents to form cured thermosetting resins.

Care should be taken to monitor the viscosity of the binder material during its application to the reinforcing fiber strands. If the viscosity of the binder precursor is too low, then during further processing of the abrasive article, the binder precursor will tend to flow or "run". This flow is undesirable and may cause the placement and orientation of the reinforcing fibers to shift. On the other hand, if the viscosity of the binder precursor is too high, then the binder precursor may not adequately wet the reinforcing fibers. A preferred viscosity range is between about 500 to 20,000 centipoise, more preferably between 1,000 and 8,000 and most preferred between 1,000 to 10,000 centipoises. These viscosity measurements are taken at room temperature. The viscosity may be adjusted by the amount of solvent (the solids of the resin) and/or the chemistry of the starting resin.

Heat may additionally be applied during the applying of the reinforcing strands to the spliced backing sheet on the temporary support to effect better wetting of the binder precursor onto the reinforcing fibers. However, the amount of heat should be controlled such that there is not premature solidification of the binder precursor.

The binder preferably should substantially engulf or encase the reinforcing fibers. The binder precursor will wet the majority of the reinforcing fibers, however there may be a minor, preferably a very minor amount of reinforcing fibers that are not engulfed by the binder precursor. There should be sufficient binder to substantially fill in any gaps or spaces between the reinforcing fibers, although at times it may be desired that some texture remains. The term "sufficient" means that there is enough binder precursor to provide an abrasive backing that has the desired properties for the intended application. These properties include tensile strength, heat resistance, tear resistance, stretch, and the like. There may be sufficient binder within a backing, and still have some internal porosity. Again, however, it is preferred that this internal porosity be minimized. Additionally, the binder will typically seal the back side of the backing to provide an continuous layer or coating on the back side of the spliced backing sheet. The term seal means that a liquid, such as water, cannot penetrate into the backing through the back side of the backing.

Typically, the binder precursor is solidified by exposure to an energy source, such as thermal energy or radiation energy. The fiber reinforced backing structure can be rotated on the drum during thermal curing. This rotation can minimize the binder precursor from flowing during its curing to form a nonsmooth contour, and thus ultimately minimizes the shifting of abrasive particles if later applied to the fiber reinforcing layer during a curing of a make coat.

One preferred method of making the reinforced backing stucture of the invention is to first provide a backing sheet spliced to the final desired belt length; this backing is then removably applied to a support structure or drum. Alternating yarns or strands of nylon and fiberglass then are applied over the spliced backing sheet by winding techniques described hereinabove. Alternatively, the two different types of fibers can be polyester and aramid. As the yarns are applied, the tension should be set such that the yarns are pulled down into the spliced backing sheet. This tension will also help promote wetting of the binder precursor onto the reinforcing yarns. There is sufficient binder precursor used to at least wet the reinforcing yarns before, during or after their application to the surface of the backing sheet.

In some instances, to make a uniform backing, the fibrous reinforcing material is applied in two wound layers, these two layers having windings which cross in inclination.

In one further optional embodiment of the invention, garnet, silica or coke particles, and the like, can be dispersed, such as by electrostatic coating, slurry coating, or spray coating, in a resin akin to that used to wet the fibrous reinforcing strands. This dispersion can be coated onto either the exposed side of the backing sheet or the fiber reinforcing layer, whichever side is opposite to the side ultimately bearing the abrasive coating, to impart texture to provide a frictional grip coat or traction coat. This traction coat can facilitate the driving of the belt. The traction coat also could be formed of a binder precursor with mineral particles or fibers dispersed therein, or woven or nonwoven webs.

Abrasive Coating

The reinforced backing structure, comprising a spliced backing sheet and the fibrous reinforcing material applied thereover as described herein, is then used as a coated abrasive backing. The abrasive coating can be applied by any known means, i.e., drop coating, slurry coating, electrostatic coating, roll coating, etc. The abrasive coating is preferably applied to the side of the backing having the spliced conventional backing due to the increased adhesion to the conventional backing over the fibers.

Once the fiber reinforced backing is formed, the introduction of abrasive particles and several adhesive layers, which are typically also applied in binder precursor form, is contemplated in the context of forming the abrasive coating surface of the article.

Make Coat

A make coat, or second adhesive layer, can be applied to either side of the backing, the spliced backing sheet side or the reinforcing fiber layer side, however the spliced backing sheet side is preferred. The make coat binder precursor can be coated by any conventional technique, such as knife coating, roll coating, rotogravure coating, and the like.

The composition of the so-called adhesive layers of this invention, which relate to the make coat and the size and supersize coats mentioned below, can be the following materials.

The adhesive layers in the coated abrasive articles of the present invention used variously as make, size and supersize coats, typically are formed from a resinous adhesive. Each of the layers can be formed from the same or different resinous adhesives. Useful resinous adhesives are those that are compatible with the organic polymeric binder material of the backing. Cured resinous adhesives are also tolerant of grinding conditions such that the adhesive layers do not deteriorate and prematurely release the abrasive material.

The resinous adhesive is preferably a layer of a thermosetting resin. Examples of useable thermosetting resinous adhesives suitable for this invention include, without limitation, phenolic resins, aminoplast resins, urethane resins, epoxy resins, acrylate resins, acrylated isocyanurate resins, urea-formaldehyde resins, isocyanurate resins, acrylated urethane resins, acrylated epoxy resins, or mixtures thereof.

Preferably, the thermosetting resin adhesive layers contain a phenolic resin, an aminoplast resin, or combinations thereof. The phenolic resin is preferably a resole phenolic resin. Examples of commercially available phenolic resins include "VARCUM" from OXY Chem Corporation, Dallas, Tex.; "AROFENE" from Ashland Chemical Company, Columbus, Ohio; and "BAKELITE" from Union Carbide, Danbury, Conn. A preferred aminoplast resin is one having at least one pendant alpha, beta-unsaturated carbonyl groups per molecule, which is made according to the disclosure of U.S. Pat. No. 4,903,440 or 5,236,472, which is incorporated herein by reference.

The make and size coats, layers 46 and 48 respectively in FIG. 4, can preferably contain other materials that are commonly utilized in abrasive articles. These materials, referred to as additives, include grinding aids, fillers, coupling agents, wetting agents, dyes, pigments, plasticizers, release agents, or combinations thereof. One would not typically use more of these materials than needed for desired results. Fillers are typically present in no more than an amount of about 90 wt %, for either the make or size coat, based upon the weight of the adhesive. Examples of useful fillers include calcium salts, such as calcium carbonate and calcium metasilicate, silica, metals, carbon, or glass.

Preferably, the adhesive layers, at least the make and size coat, the second and third adhesive layers, respectively, are formed from a calcium metasilicate filled resin treated with a silane coupling agent, such as resole phenolic resin, for example. Resole phenolic resins are preferred at least because of their heat tolerance, toughness, high hardness, and low cost. More preferably, the adhesive layers include about 50–90 wt % silane treated or calcium metasilicate in a resole phenolic resin.

Abrasive Particles

The abrasive particles suitable for this invention include fused aluminum oxide, heat treated aluminum oxide, ceramic aluminum oxide, silicon carbide, alumina zirconia, garnet, diamond, cubic boron nitride, titanium diboride, or mixtures thereof. The abrasive particles can be either shaped (e.g., rod, triangle, or pyramid) or unshaped (i.e., irregular). The term "abrasive particle" encompasses abrasive grains, agglomerates, or multi-grain abrasive granules. An example of such agglomerates is described in U.S. Pat. No. 4,652,275, which is incorporated herein by reference.

Useful aluminum oxide grains for applications of the present invention include fused aluminum oxides, heat treated aluminum oxides, and ceramic aluminum oxides. Examples of ceramic aluminum oxides are disclosed in U.S. Pat. Nos. 4,314,827, 4,744,802, and 4,770,671, which are incorporated herein by reference.

The average particle size of the abrasive particle for advantageous applications of the present invention is at least about 0.1 micrometers, preferably at least about 100 micrometers. A grain size of about 100 micrometers corresponds approximately to a coated abrasive grade 120 abrasive grain, according to American National Standards Institute (ANSI) Standard B74.18-1984. The abrasive grain can be oriented, or it can be applied to the backing without orientation, depending upon the desired end use of the coated abrasive backing.

The abrasive particles can be embedded into the make coat precursor by any conventional technique such as electrostatic coating, drop coating or magnetic coating. During electrostatic coating, electrostatic charges are applied to the abrasive particles and this propels the abrasive particles upward. Electrostatic coating tends to orient the abrasive particle, which tends to lead to better abrading performance. In drop coating, the abrasive particles are forced from a feed station and are fall into the binder precursor by gravity. It is also within the scope of this invention to propel the abrasive particles upward by a mechanical force into the binder precursor. Magnetic coating involves using magnetic forces to coat the abrasive particles.

If the abrasive particles are applied by electrostatic coating, then it is preferred that the backing be placed on a drum. This drum can be the original support structure or a different drum. The drum serves as a ground for the electrostatic coating process. The proper amount abrasive particles are then placed on plate underneath the drum. Next, the drum is rotated and the electrostatic field is turned on. As the drum rotates, the abrasive particles are embedded into the make coat. The drum is rotated until the desired amount of abrasive particles are coated. The resulting construction is exposed to conditions sufficient to solidify the make coat.

Size Coat

A size coat, or third adhesive layer, may be applied over the abrasive particles and the make coat such as by roll coating. The preferred size coat is a resole phenolic resin filled with a silane treated calcium metasilicate. For endless, splice-less belts, it is preferred to spray the size coat precursor over the abrasive particles. It may take one or two passes spraying the size coat precursor. After the size coat is applied, the size coat is solidified, typically upon exposure to an energy source. These energy sources include both thermal and radiation energy.

Supersize Coat

In some instances it may be preferred to apply a supersize coat, or fourth adhesive layer, over the size coat. The fourth adhesive layer 49 in FIG. 4, i.e., an optional supersize coat, can preferably include a grinding aid, to enhance the abrading characteristics of the coated abrasive. Examples of grinding aids include potassium tetrafluoroborate, cryolite, ammonium cryolite, or sulfur. One would not typically use more of a grinding aid than needed for desired results. The supersize coat may comprise a binder and a grinding aid.

The abrasive material can also be applied using a preformed abrasive coated laminate. This laminate consists of a sheet of material coated with abrasive grains. The sheet of material can be a piece of cloth, polymeric film, vulcanized fiber paper, and the like. Alternatively, the laminate can be that disclosed in U.S. Pat. No. 4,256,467, which is incorporated herein by reference. The laminate can be applied to the outer surface of the backing of the present invention using; any of the adhesives discussed above; thermobonding; a pressure sensitive adhesive; or mechanical fastening means, such as a hook and loop means, as is disclosed in U.S. Pat. No. 4,609,581, which is incorporated herein by reference. This could include a method of attachment by which the laminate is applied to a liquid loop of backing binder and reinforcing fiber such that the laminate is attached by curing or solidifying the liquid backing loop. This embodiment of the coated abrasive article of the present invention is advantageous at least because of the potential for removing the laminate once the abrasive material is exhausted and replacing it with another such laminate. In this way the backing of the present invention can be recycled and reused.

The following non-limiting examples will further illustrate the invention. All parts, percentages, ratios, etc., in the examples are by weight unless otherwise indicated.

EXAMPLES

The following designations are used throughout the examples.

MDPM: mixture of 35% methylene dianiline in methyl acetate;

PEGD: polyethylene glycol diacrylate, commercially available from Sartomer Co. under the tradename "SR-344";

PH2: 2-benzyl-2-N,N-dimethylamino-1-(4-morpholinophenyl)-1-butanone, commercially available from Ciba Geigy Corp. under the trade designation "IRGACURE 369";

UVA: acrylated Urethane, commercially available from Morton International under the tradename "UVITHANE 893";

UR1: a urethane resin commercially available from Uniroyal Chemical Corp. under the trade designation "BL-16".

General Procedure for Preparing the Abrasive Belt

This procedure illustrates the general method of making an abrasive article in which the binder precursor serves to engulf the reinforcing fibers and secure the abrasive particles to the backing.

A polyester backing sheet or web, 360 grams per square meter, saturated with a phenolic/latex resin blend, was cut to 30.5 cm wide and 335.6 cm long, was provided. The polyester backing sheet was a Y weight cloth having a sateen weave. To form the splice, a portion of the backing sheet, about 1 cm from each cut end, was ground off by sandblasting to form the sinusoidal contour a period of about 2.5 cm and an amplitude of 2.5 cm along each end face. The splice was set at approximately a 67 degree angle to the side edges of the sheet. A solvent based urethane splice adhesive was applied to both ground regions, the two ends were brought together to form a juncture line at their confronting ends, and a strip of polyester adhesive tape having the trade designation "T1882", manufactured by Sheldahl Co., Northfield, Minn., where the tape was 4.5 mil (114 micrometers) thick, was placed over the urethane adhesive at the juncture line. This splice area was then pressed for 8 seconds under 4000 $lb/in^2$ ($2.76\times10^7$ Pa) pressure force.

The spliced backing sheet was placed over an aluminum hub which had a circumference of 335.3 cm, a width of 38.1 cm, and a wall thickness of 0.64 cm. The hub was installed on a 7.6 cm mandrel that rotated by a DC motor and was capable of rotating from 1 to 120 revolutions per minute (rpms). This silicone coated polyester film was not a part of the backing.

A layer of resin, having the following formulation, was coated onto the spliced backing sheet at a thickness of 0.10 to 0.15 mm: 48.7 parts UR1, 15.2 parts MDPM, 18 parts UVA, 17.6 parts PEGD, and 0.5 parts PH2. After coating, the drum was rotated at 3 rpm and the resin coating was cured using a 600 watt/inch (about 235 watt/cm) "D" lamp available from Fusion Systems for 40 seconds.

A second layer of the same resin was applied at a thickness of 0.4 to 0.5 mm. Alternating 400 denier "KEVLAR 49" and 440 denier polyester fiber available from Synthetic Thread Co. Inc., Bethlehem, Penn., were wound onto the backing at about 9.4 threads of each per centimeter of belt width. The "KEVLAR" fibers strengthen the final backing and minimize stretch. The polyester fibers strengthen the backing to a lesser extent but contribute enhanced resilience. The strands were first run through a tensioner and then wound through a comb, two at a time. The reinforcing fibrous strands were wrapped over the spliced backing sheet by means of a yarn guide system with a level winder that moved across the face of the hub at a rate of 10 cm per minute. During this process, the hub rotated at 50 rpm. After wrapping, the resin and fibers were smoothed with a doctor blade, and cured for 40 seconds with the same "D" lamp. The reinforced backing was then exposed to 2 infrared curing lamps for approximately 30 minutes while the drum rotated at 3 rpm to cure the resin. After cooling to room temperature, the fiber reinforced backing structure was removed from the hub. The fiber reinforced backing structure was turned inside out, i.e., was everted, and placed under tension on a pair of idler rolls with one roll drivable by motor to rotate the backing.

A make coat resin, as defined hereinabove, was knife coated on the exposed side of spliced backing sheet opposite the fiber reinforcing layer at a coating thickness of 0.25 mm. Then, a mineral drop was performed with conventional abrasive particles in the make coat. The make coat resin was precured for 90 minutes at 90° C. Then, a size coat resin was roll coated over the mineral abrasive. The size coat resin was precured at 90 minutes at 90° C. and then final cured at 10 hours at 105° C. to form a coated abrasive article having a fiber reinforced spliced backing layer of the invention having low stretch and high tensile strength.

The invention has been described with reference to various specific and preferred embodiments and techniques. It should be understood, however, that many variations and modifications can be made while remaining within the spirit and scope of the invention.

What is claimed is:

1. A method of making a flexible coated abrasive belt comprising the steps of:

(a) providing a backing sheet having opposite first and second major surfaces, opposite ends, a length, and having generally parallel side edges;

(b) providing a temporary support structure having a peripheral surface capable of supporting said backing sheet;

(c) joining said opposite ends of said backing sheet at a splice to form a spliced endless backing sheet;

(d) contacting said first major surface of said backing sheet with said peripheral surface;

(e) applying fibrous reinforcing material onto said second major surface of said spliced endless backing sheet in a plurality of revolutions around said spliced endless backing sheet in a path along said length;

(f) applying a coating of a first binder precursor onto said fibrous reinforcing material to said second major surface to form a reinforcing fiber layer;

(g) exposing said coating of first binder precursor applied in step (f) to conditions effective to solidify said first binder precursor to form an endless reinforced backing structure;

(h) removing said endless reinforced backing structure from said temporary support structure;

(i) everting said reinforced backing structure; and (j) applying an abrasive coating comprising binder and abrasive particles on said first major surface thereby forming a coated abrasive belt.

2. The method of claim 1, wherein said fibrous reinforcing material comprises a fibrous reinforcing strand.

3. The method of claim 2, wherein said fibrous reinforcing strand is a material selected from the group consisting of glass, steel, carbon, ceramic, wool, silk, cotton, cellulose, polyvinyl alcohol, polyamide, polyester, rayon, acrylic, polypropylene, phenol and aramid.

4. The method of claim 1, wherein said spliced endless backing sheet is material selected from the group consisting of polymeric film, cloth, paper, vulcanized fiber sheet, and combinations thereof.

5. The method of claim 1, wherein said temporary support structure is a drum and said step of joining said opposite ends of said backing sheet is carried out on said drum.

6. The method of claim 3, wherein said fibrous reinforcing material is helically wound onto said second major surface of said spliced endless backing longitudinally to form said fiber reinforcing layer.

7. The method of claim 6, wherein said fibrous reinforcing layer has a fiber spacing of about 2 to 50 strands per cm of lateral width of said second major surface of said backing sheet.

8. The method of claim 6, wherein said reinforcing fiber layer spans substantially the entire lateral width of said second major surface of said endless backing sheet.

9. The method of claim 3, wherein said reinforcing material comprises at least two individual reinforcing strands of different reinforcing material onto said second major surface of said spliced endless backing along said length continuously to span substantially the entire lateral width of said second major surface.

10. The method of claim 9, wherein said different reinforcing material comprises glass and polyamide.

11. The method of claim 9, wherein said different reinforcing material comprises aramid and polyester.

12. The method of claim 1, further comprising additionally applying said first binder precursor to said second major surface of said spliced endless backing sheet prior to said applying of said fibrous reinforcing material onto said second major surface.

13. The method of claim 1, wherein step (c) is conducted after step (d).

14. The method of claim 1, wherein said first binder precursor is applied prior to the application of the fibrous reinforcing material.

15. The method of claim 1, wherein step (e) is conducted simultaneously with step (f).

16. The method of claim 1, further comprising applying a frictional coating on the surface of said belt opposite said abrasive coating.

17. A method of making a flexible coated abrasive belt comprising the steps of:

(a) providing an elongate backing sheet having first and second free sheet ends, first and second opposite major surfaces, and a length with generally parallel side edges;

(b) providing a temporary support structure having a peripheral surface capable of supporting said elongate backing sheet;

(c) joining said two free sheet ends together to provide a splice thereby forming an endless backing sheet having opposing first and second major surfaces corresponding respectively to said first and second major surfaces of said elongate backing sheet;

(d) contacting said first major surface of said endless backing sheet with said peripheral surface;

(e) applying fibrous reinforcing material onto said second major surface of said endless backing sheet in a plurality of revolutions around said endless backing sheet in a path along said length;

(f) applying a coating of a first binder precursor onto said fibrous reinforcing material to bond said fibrous reinforcing material to said second major surface of said endless backing sheet to form a reinforcing fiber layer;

(g) exposing said coating applied in (f) to conditions effective to solidify said first binder precursor to form a reinforced endless backing structure;

(h) removing said reinforced endless backing structure from said temporary support structure;

(i) everting said reinforced endless backing structure;

(j) applying a second binder precursor layer to said first major surface of said reinforced endless backing structure;

(k) applying a plurality of abrasive particles to said second binder precursor layer to form an abrasive coating; and (l) exposing said abrasive coating to conditions effective to solidify said second binder precursor to form a coated abrasive belt.

18. The method of claim 17; wherein first binder precursor is applied to said fibrous reinforcing material either before, simultaneously with, or after said application of said fibrous reinforcing material to said second major surface of said endless backing sheet.

19. The method of claim 17, wherein said abrasive particles are applied to said second binder precursor layer by a particle coating technique selected from the group consisting of electrostatic coating, drop coating, and magnetic coating.

20. The method of claim 17, further including the step of applying a third binder precursor layer onto said abrasive particles and solidifying said third binder precursor layer.

21. The method of claim 17, wherein said splice is a butt splice.

22. The method of claim 17, wherein the splice is a lap splice.

23. The method of claim 17, wherein said elongate backing sheet comprises a cloth structure, wherein said cloth structure is coated with a liquid organic binder material prior to being applied around said temporary support structure.

24. The method of claim 17, wherein said fibrous reinforcing material is a fibrous reinforcing strand.

25. The method of claim 17, wherein said fibrous reinforcing material is helically wound around said second major surface along said length.

26. The method of claim 17, further comprising additionally applying said first binder precursor to said second major surface of said spliced endless backing sheet prior to said applying of said fibrous reinforcing material onto said second major surface.

27. A method of making a flexible coated abrasive belt comprising the steps of:

(a) providing a strip of coated abrasive sheet material including (i) a backing sheet having opposite first and second major surfaces, opposite ends, a length, and having generally parallel side edges, and (ii) an abrasive coating comprising binder and abrasive particles adhered on said first major surface of said backing sheet;

(b) providing a temporary support structure having a peripheral surface capable of supporting said elongate backing sheet;

(c) contacting said abrasive coming with said peripheral surface before or after joining said opposite ends of said backing sheet at a splice thereby forming a spliced endless coated abrasive sheet material;

(d) applying fibrous reinforcing material onto said second major surface of said spliced endless coated abrasive sheet material in a plurality of revolutions around and against said second major surface in a path along said length;

(e) applying a backing binder precursor to said fibrous reinforcing material to bond said fibrous reinforcing material to said second major surface of said backing sheet to form a reinforcing layer; and (f) exposing the backing binder precursor to conditions effective to solidify said backing binder precursor.

28. The method of claim 27, wherein said fibrous reinforcing material is a fibrous strand.

29. The method of claim 27, wherein said fibrous reinforcing material is helically wound around said second major surface along said length.

* * * * *